US007328562B2

(12) United States Patent
Chang

(10) Patent No.: US 7,328,562 B2
(45) Date of Patent: Feb. 12, 2008

(54) STIRRUP WITH GAS-FILLED SHOCK ABSORBER

(76) Inventor: Chia Wei Chang, 12184 Ponce De Leon Dr., Moreno Valley, CA (US) 92557

( * ) Notice: Subject to any disclaimer, the term of this patent is extended or adjusted under 35 U.S.C. 154(b) by 0 days.

(21) Appl. No.: 11/317,716

(22) Filed: Dec. 23, 2005

(65) Prior Publication Data

US 2006/0096256 A1 May 11, 2006

Related U.S. Application Data

(63) Continuation-in-part of application No. 10/975,218, filed on Oct. 28, 2004, now Pat. No. 7,114,315, which is a continuation-in-part of application No. 10/899,473, filed on Jul. 26, 2004, now Pat. No. 7,065,943, which is a continuation-in-part of application No. 10/367,107, filed on Feb. 14, 2003, now Pat. No. 6,766,632, which is a continuation-in-part of application No. 10/056,561, filed on Jan. 25, 2002, now abandoned.

(51) Int. Cl.
*B68C 3/00* (2006.01)

(52) U.S. Cl. ..... 54/48; 54/47

(58) Field of Classification Search ..... 54/47, 54/48, 49, 49.5; 482/49
See application file for complete search history.

(56) References Cited

U.S. PATENT DOCUMENTS

| | | | | |
|---|---|---|---|---|
| 9,609 | A * | 3/1853 | Brower | 54/47 |
| 33,354 | A | 9/1861 | Livingston | |
| 103,031 | A | 5/1870 | Dunnagan | |
| 202,974 | A | 4/1878 | Wiley | |
| 222,556 | A | 12/1879 | Whitman | |
| 320,194 | A * | 6/1885 | Turner | 54/47 |
| 376,526 | A | 1/1888 | Jennings et al. | |
| 1,160,082 | A | 11/1915 | Jarvis | |
| 1,622,510 | A | 3/1927 | Hendriks | |
| 1,639,073 | A | 8/1927 | Berbaum | |
| 2,098,141 | A | 11/1937 | Galbreath | 54/48 |
| 2,187,983 | A | 1/1940 | Moore | 54/47 |
| 3,804,216 | A | 4/1974 | Katsumori et al. | 188/314 |
| 3,905,179 | A | 9/1975 | Bischeltsrieder | 54/47 |
| 4,199,639 | A | 4/1980 | Rone | 428/138 |
| 4,936,081 | A | 6/1990 | Jones | 54/48 |
| 5,056,504 | A * | 10/1991 | Mann | 601/40 |
| 5,172,538 | A | 12/1992 | Luger | 54/47 |

(Continued)

FOREIGN PATENT DOCUMENTS

DE 3317859 A1 11/1984

(Continued)

*Primary Examiner*—Rob Swiatek
(74) *Attorney, Agent, or Firm*—Antonio R. Durando

(57) ABSTRACT

A stirrup (210,310) includes a footrest (214,314) as well as a hanger (216,316) for suspending the stirrup from a saddle. A shock absorber (350) is provided for the footrest (314) and has passages (364) which allow the shock absorber to be tied to the footrest. Each of the passages (364) extends between two opposite surfaces of the shock absorber (350) and is made up of two tapering portions (374) which narrow in a direction away from the respective surfaces.

27 Claims, 17 Drawing Sheets

U.S. PATENT DOCUMENTS

| | | | | |
|---|---|---|---|---|
| 5,896,681 | A * | 4/1999 | Lin | 36/28 |
| 5,930,986 | A | 8/1999 | Meaghan et al. | 54/47 |
| 5,979,149 | A | 11/1999 | Martin | 54/49 |
| 6,062,007 | A | 5/2000 | Cargill | 54/47 |
| 6,220,004 | B1 | 4/2001 | Hsi-Chang | 54/48 |
| 6,425,230 | B2 | 7/2002 | Vollmecke et al. | 54/48 |
| 6,766,632 | B2 | 7/2004 | Chang | 54/48 |
| 2001/0045084 | A1 | 11/2001 | Vollmecke et al. | 54/47 |

FOREIGN PATENT DOCUMENTS

| | | |
|---|---|---|
| WO | WO 95/25692 | 9/1995 |

* cited by examiner

STIRRUP WITH GAS-FILLED SHOCK ABSORBER

REFERENCE TO RELATED APPLICATIONS

This is a continuation-in-part of application Ser. No. 10/975,218 filed 28 Oct. 2004 by Chia Wei Chang for "Nonslip Article For A Stirrup", now U.S. Pat. No. 7,114,315, which, in turn, is a continuation-in-part of application Ser. No. 10/899,473 filed 26 Jul. 2004 by Chia Wei Chang for "A Stirrup With Footrest Having A Gas Filled Shock Absorber", now U.S. Pat. No. 7,065,943, which, in turn, is a continuation-in-part of application Ser. No. 10/367,107 filed 14 Feb. 2003 by Chia Wei Chang for "A Stirrup With Relatively Movable Footrest and Hanger", now U.S. Pat. No. 6,766,632, which, in turn, is a continuation-in-part of application Ser. No. 10/056,561 filed 25 Jan. 2002 by Chang Hsi-Chang for "A Stirrup With Clamped Shock-Absorbing Pads", now abandoned.

BACKGROUND OF THE INVENTION

1. Field of the Invention

The invention relates to a stirrup and a shock absorber for the stirrup.

2. Description of the Prior Art

Stirrups come in different forms. The above-referenced applications disclose a type of stirrup having a metallic footrest and a metallic hanger for suspending the stirrup from a saddle. The footrest is provided with an opening which is used to mount one or more shock absorbers on the footrest. An uppermost surface of the shock absorber or shock absorbers is nonslip to prevent the foot of a rider from sliding out of the stirrup.

SUMMARY OF THE INVENTION

One aspect of the invention resides in a stirrup. The stirrup comprises a support for a foot and a suspending element for suspending the support on an animal. The support includes a peripheral wall which circumscribes an opening having a predetermined shape or outline and a predetermined area, and the support further includes a plate-like member in the opening. The plate-like member is fixed to the peripheral wall and has approximately the predetermined shape or outline, as well as approximately the predetermined area, of the opening.

The support can additionally include at least one bracing member for supporting the plate-like member. The bracing member may be mounted on the peripheral wall and span at least the major part of the opening in the support.

The plate-like member can be fixed to the peripheral wall by one or more fusional bonds. Fusional bonds include, for example, those formed by welding, brazing and soldering.

The plate-like member may be provided with means for releasably connecting an object to the plate-like member. The connecting means preferably comprises apertures in the plate-like member.

The plate-like member has opposed major sides and the suspending element is located to one of these sides. The peripheral wall and the plate-like member may define a space to the other of the major sides of the plate-like member and, in such an event, the stirrup can include a cover for the space. At least one of the peripheral wall and the plate-like member may be provided with means for releasably securing the cover to the peripheral wall.

The stirrup can additionally comprise a nonslip member or tread for inhibiting slippage of a foot resting on the support of the stirrup.

Another aspect of the invention resides in a shock absorber for the footrest of a stirrup. One embodiment of the shock absorber includes a shock-absorbing body having means for releasably attaching the shock-absorbing body to the footrest. The attaching means is designed to permit tying of the shock-absorbing body to the footrest.

It is preferred for at least the major part of the shock-absorbing body to be inflated with gas, e.g., air.

The shock-absorbing body may have opposed surfaces and the attaching means can then comprise passages which extend from one of the surfaces to the other of the surfaces.

The present embodiment of the shock absorber of the invention can be used with a stirrup according to the invention. Such stirrup can comprise one or more tying members designed to extend through the passage or passages in the shock-absorbing body and tie the latter to the plate-like member of the stirrup. The shock-absorbing body may be provided with one or more indentations at one or both of the above-mentioned surfaces thereof, and each indentation is designed to receive a part of a tying member so that such part of the tying member is recessed relative to the adjoining surface.

The peripheral wall of the stirrup may be formed with one or more cutouts and the shock-absorbing body can then be provided with one or more ribs which are complementary to respective ones of the cutouts.

An additional embodiment of the shock absorber in accordance with the invention comprises a shock-absorbing body which is inflated with gas throughout at least the major part thereof and is provided with means for stabilizing the shock-absorbing body.

The stabilizing means can include at least one passage having at least one tapering portion and such tapering portion can, for instance, be frustoconical. Advantageously, the stabilizing passage is provided with a pair of tapering portions. In such an event, one tapering portion may extend from a first surface of the shock-absorbing body partway to an opposed second surface of the shock-absorbing body while the other tapering portion extends from the second surface partway to the first surface. Each of the tapering portions has a wider end and a narrower end, and the narrower ends are preferably in register with and abut one another.

A further aspect of the invention resides in a method of mounting a shock absorber on a stirrup. The method comprises the steps of positioning the shock absorber on the stirrup and tying the shock absorber to the stirrup.

The tying step may include the operations of passing a tying member through the shock absorber and securing the tying member to the stirrup. The tying step can also involve the operations of passing a tying member through a component of the stirrup and securing the tying member to such component.

Additional features and advantages of the invention will be forthcoming from the following detailed description of specific embodiments when read in conjunction with the accompanying drawings.

DESCRIPTION OF THE PREFERRED EMBODIMENTS

Figure 1:
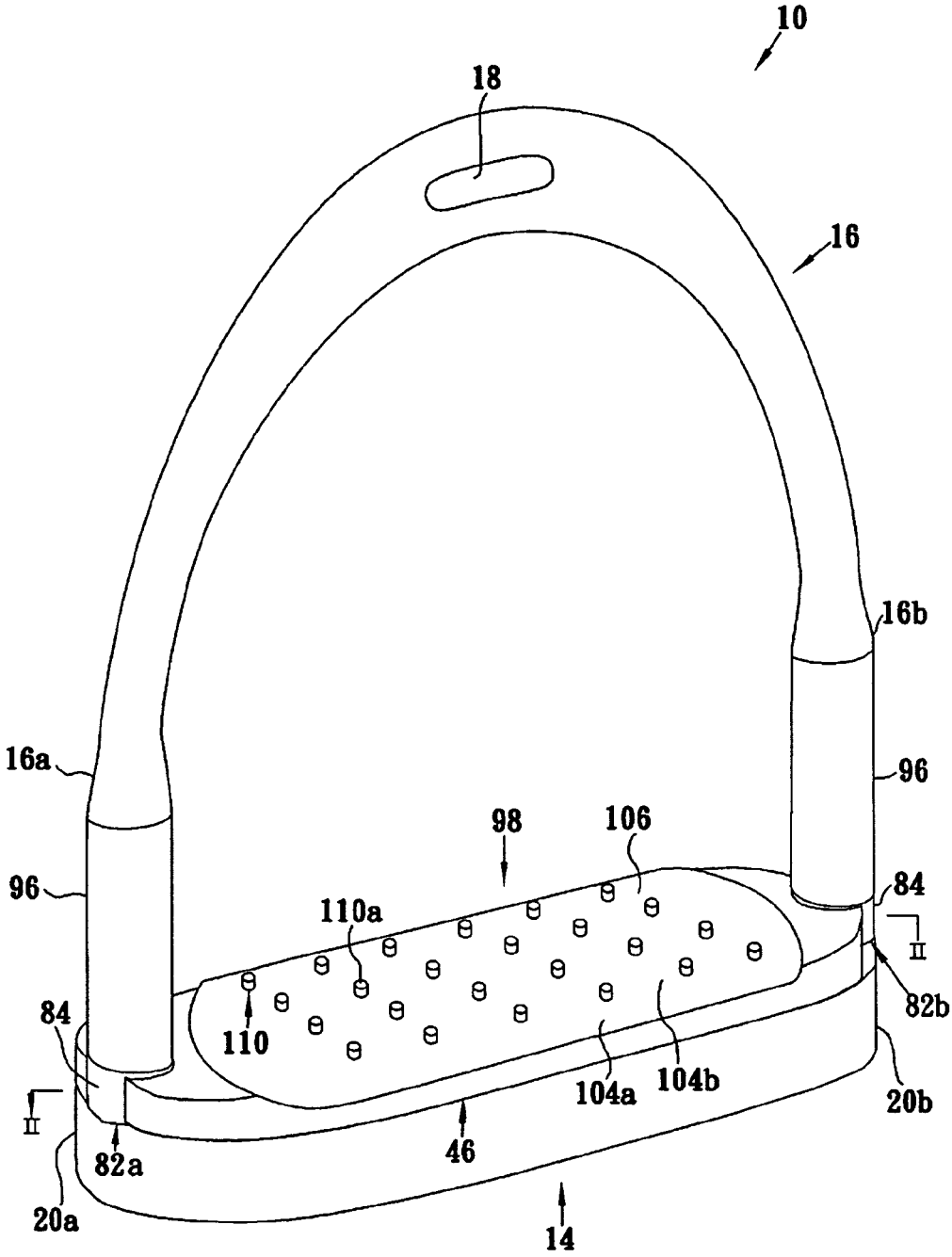
FIG. 1 is a perspective view of one embodiment of a stirrup which is designed in accordance with the invention and includes a footrest, a shock-absorbing body on the footrest and a nonslip tread overlying the shock-absorbing body.
Figure 2:
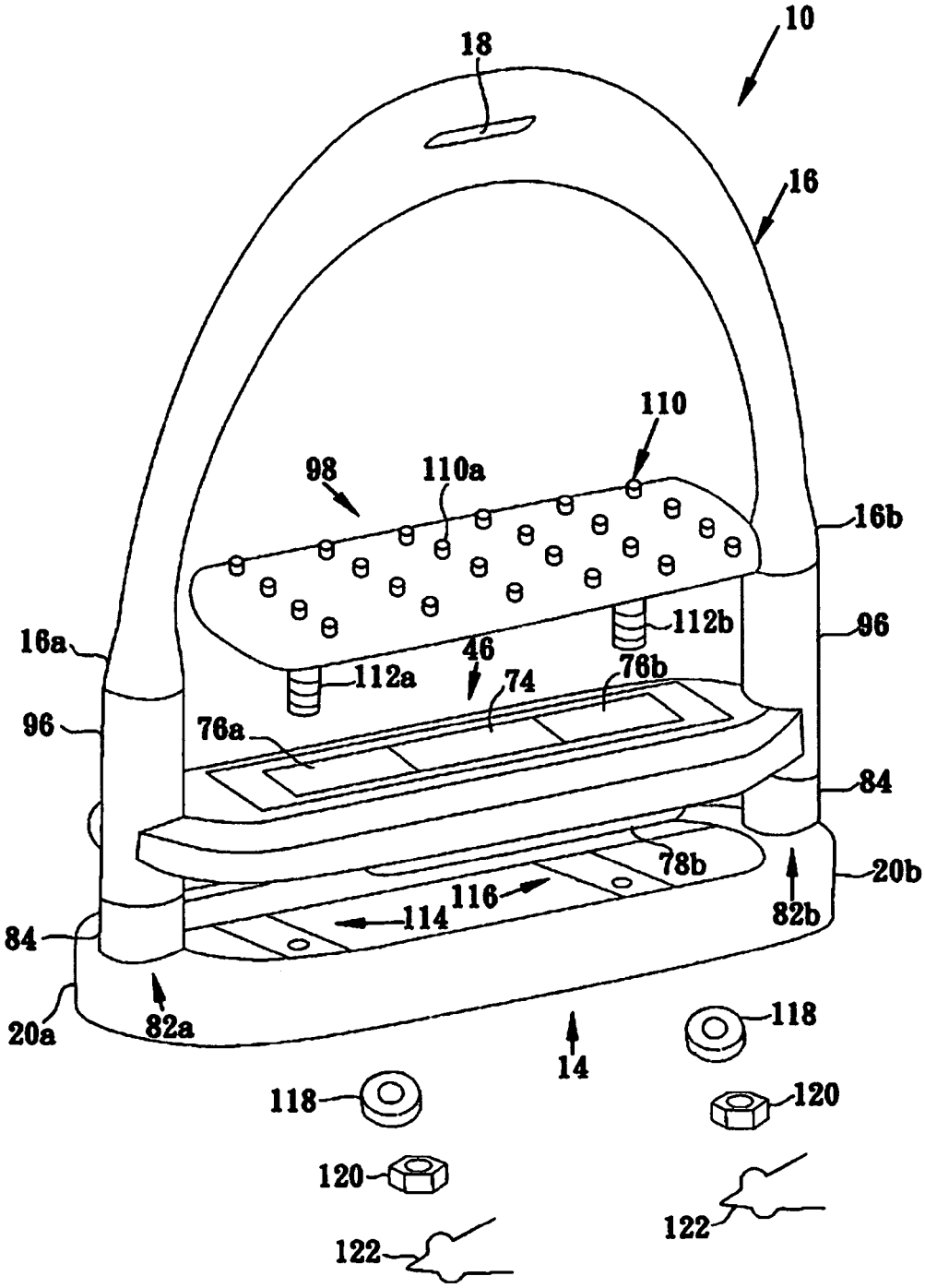
FIG. 2 is a partially exploded perspective view of the stirrup of FIG. 1.

Referring to FIGS. 1 and 2, the numeral 10 identifies a stirrup according to the invention. The stirrup 10 includes a rigid metallic footrest 14 which constitutes a support for a foot and a U-shaped, rigid metallic hanger or suspending element 16 which serves to suspend the stirrup 10 from an animal such as a horse, e.g., from a saddle mounted on the animal. The hanger 16, which is centered with respect to the footrest 14 laterally of the latter, is provided with a slot 18 for attaching the hanger 16 to the animal.

Figure 3:
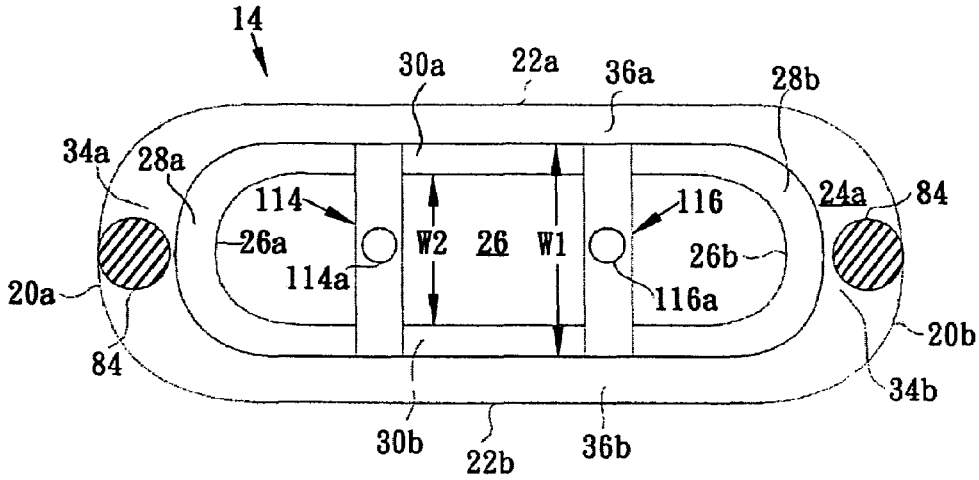
FIG. 3 is a section in the direction of the arrows II-II of FIG. 1 with the shock-absorbing body and the nonslip tread removed to present a top view of the footrest of FIG. 1.
Figure 4:
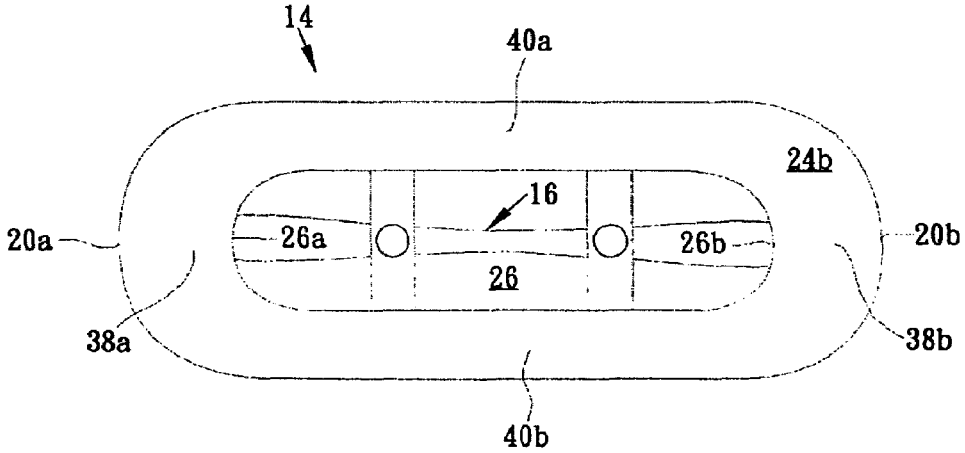
FIG. 4 is a bottom view of the footrest.
Figure 5:
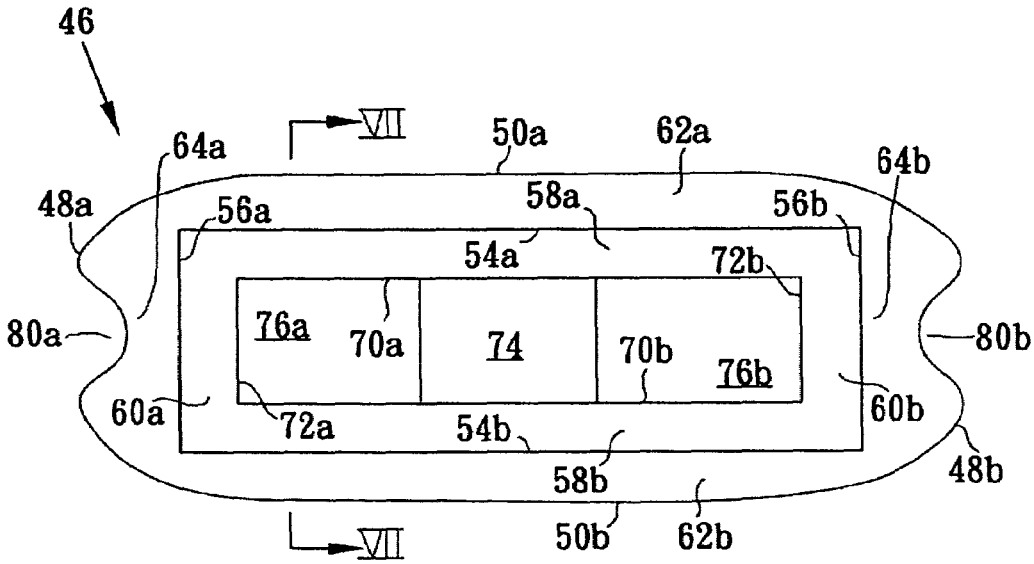
FIG. 5 is a top view of the shock-absorbing body of FIG. 1.
Figure 6:
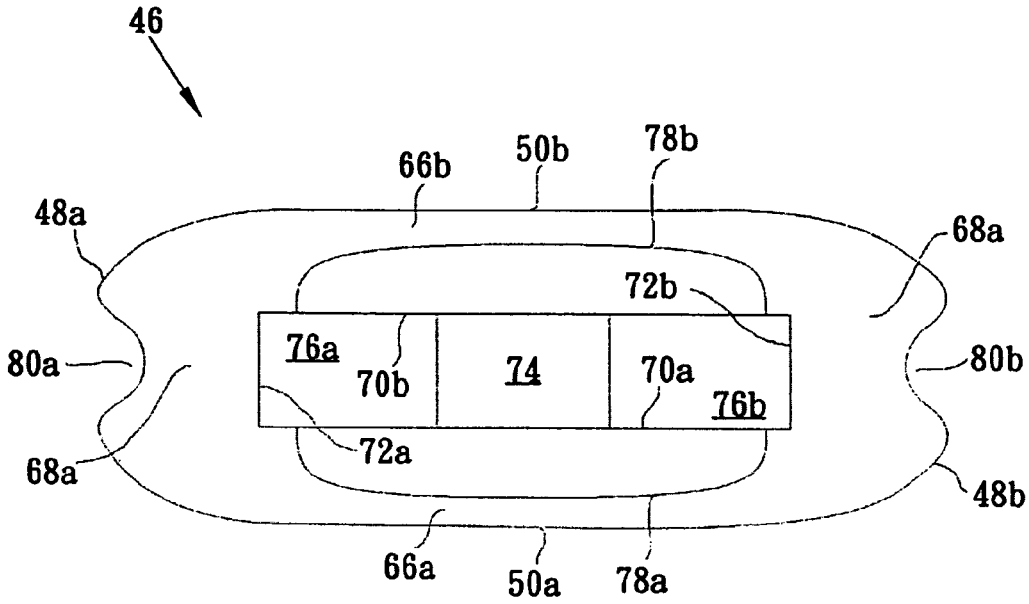
FIG. 6 is a bottom view of the shock-absorbing body of FIG. 5.
Figure 7:
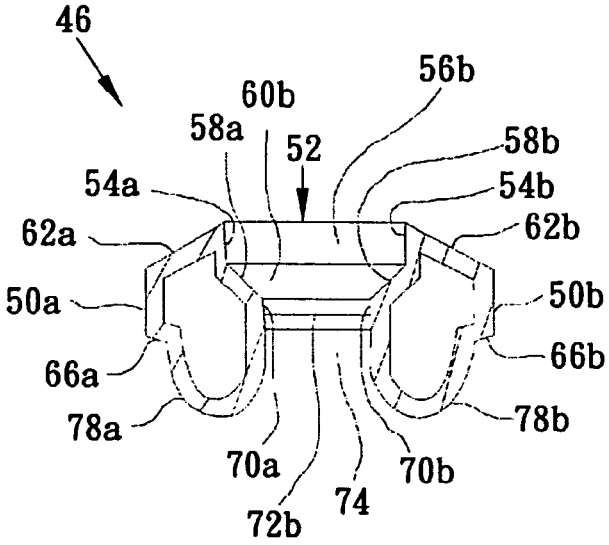
FIG. 7 is a sectional view of the shock-absorbing body of FIG. 5 as seen in the direction of the arrows VII-VII of FIG. 5.

Considering FIGS. 3 and 4 with FIGS. 1 and 2, the footrest 14 is elongated and has opposed longitudinal ends 20*a* and 20*b* which are convex as seen in a plan view. The footrest 14 further has two opposed longitudinally extending sides 22*a* and 22*b* which bridge the longitudinal ends 20*a*,20*b*, and the sides 22*a*,22*b* are straight and parallel to one another. In addition, the footrest 14 has two flat parallel surfaces 24*a* and 24*b* lying in respective planes which are generally perpendicular to the straight sides 22*a* and 22*b*. The flat surfaces 24*a*,24*b* face in opposite directions, and the straight sides 22*a*,22*b* run from one of the flat surfaces 24*a*,24*b* to the other. In use, the flat surface 24*a* faces up and can be considered to be an upper surface of the footrest 14 while the flat surface 24*b* faces down and can be considered to be a lower surface of the footrest 14.

The footrest 14 is formed with an elongated opening 26 having a shape similar to that of the footrest 14. The opening 26 has opposed longitudinal ends 26*a* and 26*b*, and the longitudinal end 26*a* of the opening 26 is located in the vicinity of the longitudinal end 20*a* of the footrest 14 while the longitudinal end 26*b* of the opening 26 is located in the vicinity of the longitudinal end 20*b* of the footrest 14. The elongated opening 26 extends from the upper surface 24*a* of the footrest 14 to the lower surface 24*b* and is bounded by a wall which slopes from the upper surface 24*a* to a location near the lower surface 24*b*. This wall has a concave segment 28*a* at the longitudinal end 26*a* of the opening 26 and a concave segment 28*b* at the longitudinal end 26*b* of the opening 26. The wall bounding the opening 26 further has two opposed segments 30*a* and 30*b* which face each other and run in the same direction as the straight sides 22*a*,22*b* of the footrest 14. Each of the segments 30*a*,30*b* extends from one of the concave segments 28*a*,28*b* to the other.

The wall 28*a*,28*b*,30*a*,30*b* bounding the elongated opening 26 in the footrest 14 slopes in such a manner that the cross-sectional area of the opening 26 at the upper surface 24*a* of the footrest 14 exceeds the cross-sectional area at the lower surface 24*b*. The elongated opening 26 has a maximum width W1 at the upper surface 24*a* and a smaller maximum width W2 at the lower surface 24*b*. Both the cross-sectional area and the maximum width of the elongated opening 26 decrease progressively from the upper surface 24*a* to the location where the wall 28*a*,28*b*,30*a*,30*b* stops sloping.

The upper surface 24*a* of the footrest 14 is made up of two curved sections 34*a* and 34*b* and two straight, strip-like sections 36*a* and 36*b*. The curved sections 34*a*,34*b* are respectively located at the longitudinal ends 26*a*,26*b* of the opening 26 in the footrest 14 while the strip-like sections 36*a*,36*b* run along opposite sides of the opening 26. Each of the strip-like sections 36*a*,36*b* bridges the curved sections 34*a*,34*b*.

In a similar fashion, the lower surface 24*b* of the footrest 14 is made up of two curved sections 38*a* and 38*b* and two straight, strip-like sections 40*a* and 40*b*. The curved sections 38*a*,38*b* are respectively located at the longitudinal ends 26*a*,26*b* of the opening 26 in the footrest 14 while the strip-like sections 40*a*,40*b* run along opposite sides of the opening 26. Each of the strip-like sections 40*a*,40*b* bridges the curved sections 38*a*,38*b*.

Referring to FIGS. 1, 2, 5, 6 and 7, the stirrup 10 comprises an elongated shock-absorbing or cushioning body 46 having opposed longitudinal ends 48*a* and 48*b*. The shock-absorbing body 46 further has two opposed longitudinally extending sides 50*a* and 50*b* which bridge the longitudinal ends 48*a*,48*b*, and the sides 50*a*,50*b* are generally straight and parallel to one another.

The shock-absorbing body 46 is provided with a depression 52 which is bounded by a rectangle including two longer straight surface sections 54*a* and 54*b* and two shorter straight surface sections 56*a* and 56*b*. The longer surface sections 54*a*,54*b* are generally parallel to one another and to the straight sides 50*a*,50*b* of the shock-absorbing body 46. The depression 52 further has a bottom defined by two longer sloping surface sections 58*a* and 58*b* and two shorter sloping surface sections 60*a* and 60*b*. The longer sloping surface sections 58*a*,58*b* run along the respective longer straight surface sections 54*a*,54*b* while the shorter sloping surface sections 60*a*,60*b* run along the respective shorter straight surface sections 56*a*,56*b*.

A sloping surface section 62*a* lies between the straight side 50*a* of the shock-absorbing body 46 and the longer straight surface section 54*a* of the depression 52. Similarly, a sloping surface section 62*b* lies between the straight side 50*b* of the shock-absorbing body 46 and the longer straight surface section 54*b* of the depression 52. The sloping surface sections 62*a*,62*b* bridge the longitudinal ends 48*a*,48*b* of the shock-absorbing body 46, and each of the sloping surface sections 62*a*,62*b* merges into a transverse surface section 64*a* on the longitudinal end 48*a* and a transverse surface section 64*b* on the longitudinal end 48*b*. The transverse surface sections 64*a*,64*b*, which may or may not be sloped, extend transversely of the shock-absorbing body 46 between the sloping surface sections 62*a*,62*b*. The sloping surface sections 62*a*,62*b*, as well as the transverse surface sections 64*a*,64*b*, normally face upward during use and can thus be considered to constitute upper surface sections of the shock-absorbing body 46.

The shock-absorbing body 46 has two additional surface sections 66*a* and 66*b* which face away from the sloping upper surface sections 62*a*,62*b*. The additional surface sections 66*a*,66*b* bridge the longitudinal ends 48*a*,48*b* of the shock-absorbing body 46, and each of the additional surface sections 66*a*,66*b* merges into a transverse surface section 68*a* on the longitudinal end 48*a* and a transverse surface section 68*b* on the longitudinal end 48*b*. The transverse surface sections 68*a*,68*b* extend transversely of the shock-absorbing body 46 between the additional surface sections 66*a*,66*b*. The additional surface sections 66*a*,66*b*, as well as the transverse surface sections 68*a*,68*b*, face downward during use and can thus be considered to constitute lower surface sections of the shock-absorbing body 46.

An elongated opening is formed centrally of the shock-absorbing body 46 between the sloping surface sections 58*a*,58*b*,60*a*,60*b* of the depression 52 and the lower surface sections 66*a*,66*b*,68*a*,68*b* of the shock-absorbing body 46. The opening, which registers with the depression 52, is bounded by a rectangle including two longer straight surface sections 70*a* and 70*b* and two shorter straight surface sections 72*a* and 72*b*. The longer surface sections 70*a*,70*b* are generally parallel to one another and to the straight sides 50*a*,50*b* of the shock-absorbing body 46.

A crosspiece 74 centered longitudinally of the opening in the shock-absorbing body 46 bridges the longer surface sections 70*a*,70*b* of the opening. The crosspiece 74 divides the opening into two apertures or spaces 76*a* and 76*b*.

The lower surface section 66*a* of the shock-absorbing body 46 is formed with an elongated rib or protuberance 78*a* which extends longitudinally of the shock-absorbing body 46. Likewise, the lower surface section 66*b* of the shock-absorbing body 46 is provided with an elongated rib or protuberance 78*b* which runs longitudinally of the shock-absorbing body 46. The ribs 78*a*,78*b* are arranged so that, when the shock-absorbing body 46 is properly placed on the footrest 14, the rib 78*a* lies proximate to or against the wall segment 30*a* of the opening 26 in the footrest 14 while the rib 78*b* lies proximate to or against the opposing wall segment 30*b*. The length of the rib 78*a* is equal to or less than the length of the wall segment 30*a* of the opening 26 and the length of the rib 78*b* is equal to or less than the length of the wall segment 30*b*. The ribs 78*a*,78*b* serve to position or align the shock-absorbing body 46 on the footrest 14 transversely of the latter.

Figure 8:
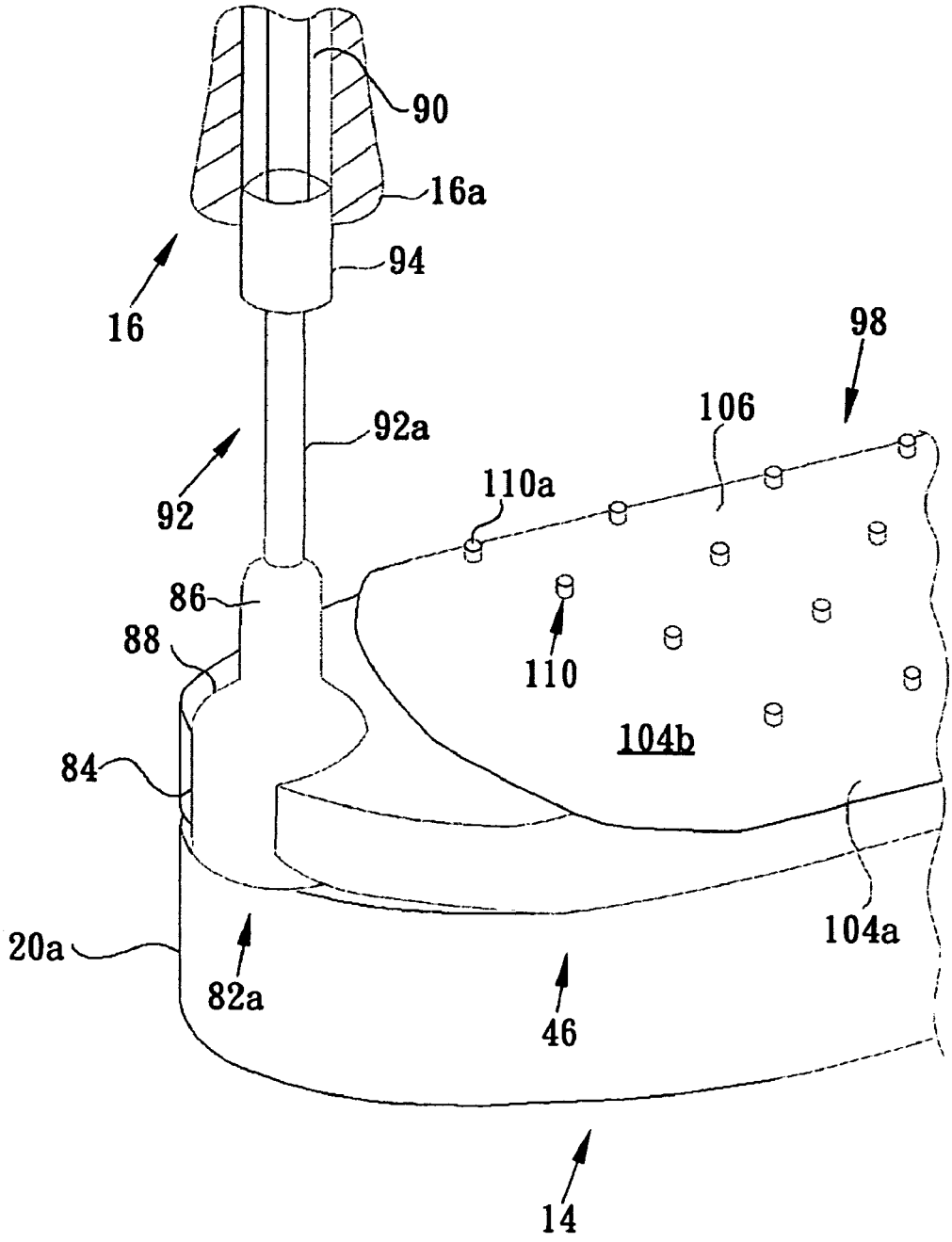
FIG. 8 is an enlarged, fragmentary, partly sectional perspective view of the stirrup of FIG. 1 with a sleeve forming part of the stirrup removed.
Figure 9:
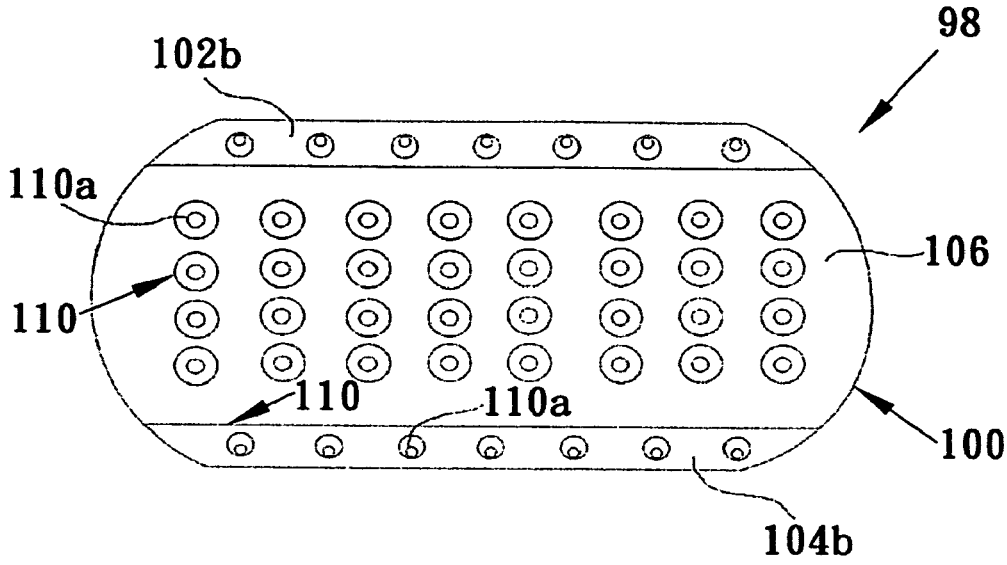
FIG. 9 is a plan view of the nonslip tread of FIG. 1.
Figure 10:
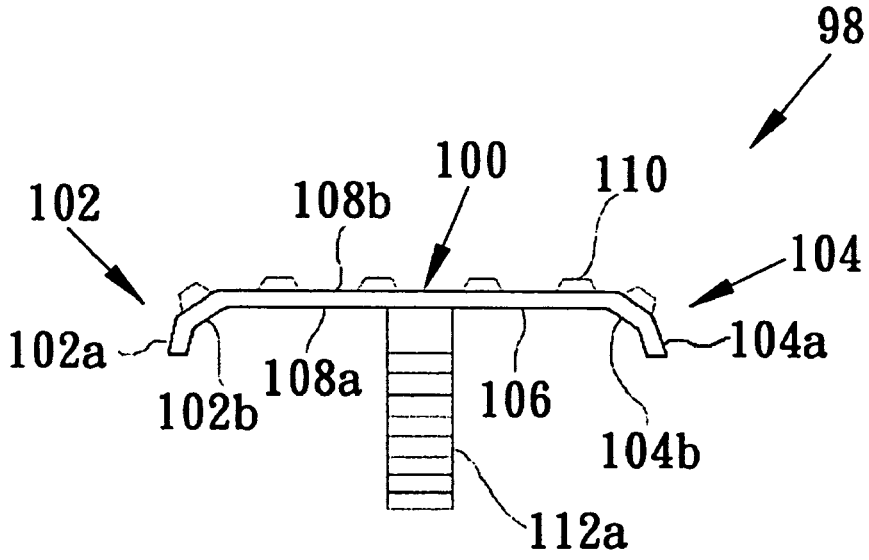
FIG. 10 is an end view of the nonslip tread of FIG. 1 as seen in the direction of the arrow X of FIG. 9.

Turning to FIG. 8 in conjunction with FIGS. 1 and 2, the footrest 14 and the hanger 16 constitute two separate components which are connected to one another flexibly or elastically. The flexible or elastic connection between the footrest 14 and the hanger 16 allows the footrest 14 and the hanger 16 to move relative to each other. In the illustrated embodiment, the flexible or elastic connection is such that the footrest 14 and the hanger 16 can rotate or pivot with respect to one another on an axis parallel to the longitudinal axis of the footrest 14.

The hanger 16 has an end portion 16*a* at the longitudinal end 20*a* of the footrest 14 and another end portion 16*b* at the opposite longitudinal end 20*b* of the footrest 14, and the end portions 16*a*,16*b* face the footrest 14. The end portion 16*a* of the hanger 16 and the longitudinal end 20*a* of the footrest 14 are joined to each other flexibly or elastically as are the end portion 16*b* of the hanger 16 and the longitudinal end 20*b* of the footrest 14.

An anchoring element 82*a* is mounted on the upper surface 24*a* of the footrest 14 at the longitudinal end 20*a* of the footrest 14 while an anchoring element 82*b* is mounted on the upper surface 24*a* at the longitudinal end 20*b*. As illustrated in FIG. 8 for the anchoring element 82*a*, each of the anchoring elements 82*a*,82*b* includes a cylindrical portion 84 of circular cross section having a larger diameter, a cylindrical portion 86 of circular cross section having a smaller diameter and a frustoconical portion 88 connecting the cylindrical portions 84*a*,84*b* to one another. The larger cylindrical portion 84 of each anchoring element 82*a*,82*b* sits on the upper surface 24*a* of the footrest 14 and serves as a base for the smaller cylindrical portion 86.

The hanger 16 of the stirrup 10 is provided with a passage 90 which runs from the end portion 16*a* of the hanger 16 to the end portion 16*b* thereof. A wire or cable 92 extends through the passage 90 and has opposite end portions 92*a* (only one visible in the drawings) which respectively project from the end portions 16*a*,16*b* of the hanger 16. Part of each wire end portion 92*a* is embedded in and gripped by the respective anchoring element 82*a*,82*b* so that the wire 92 is anchored to the footrest 14 and establishes a connection between the footrest 14 and the hanger 16.

The end portions 16*a*,16*b* of the hanger 16 are spaced from the respective anchoring elements 82*a*,82*b* by gaps, and the part of each wire end portion 92*a* which is not embedded in the respective anchoring element 82*a*,82*b* bridges the corresponding gap. The wire 92 is flexible or elastic thereby allowing the parts of the wire 92 between the hanger 16 and the anchoring elements 82*a*,82*b* to bend. When the parts of the wire 92 between the hanger 16 and the anchoring elements 82*a*,82*b* are bent about an axis running parallel to the longitudinal axis of the footrest 14, the footrest 14 and the hanger 16 rotate relative to one another on this axis. The wire 92 can, for example, be made of steel.

The passage 90 of the hanger 16 has a circular cross section and a plug or insert 94 of circular cross section extends into the passage 90 through each of the end portions 16*a*,16*b* of the hanger 16 (only the plug 94 for the end portion 16*a* is shown in the drawings). Each of the plugs 94 is provided with a channel of circular cross section for the wire 92, and each of the plugs 94 is arranged so that part of the respective plug 94 is located internally of the hanger 16 and part is located externally of the hanger 16. The plugs 94 are fast with the hanger 16 and can be a friction fit in the passage 90 and/or can be attached to the hanger 16 in a suitable manner.

Each of the two parts of the wire 92 spanning the hanger 16 and the anchoring elements 82*a*,82*b* is surrounded by a sleeve or housing 96 of circular cross section, and each of the sleeves 96 is formed with a passage of circular cross section. One end of each sleeve 96 receives the smaller cylindrical portion 86 of the respective anchoring element 82*a*,82*b* while the other end of each sleeve 96 receives the part of the respective plug 94 located externally of the hanger 16. The plugs 94 and the smaller cylindrical portions 86 of the anchoring elements 82*a*,82*b* are fast with the sleeves 96, and the plugs 94 and smaller cylindrical portions 86 can be a friction fit in the sleeves 96 and/or can be attached to the sleeves 96 in a suitable manner.

The sleeves 96 are flexible or elastic thereby allowing the sleeves 96 to bend together with the parts of the wire 92 between the hanger 16 and the anchoring elements 82*a*,82*b*. By virtue of the construction in the illustrated embodiment of the stirrup 10, the sleeves 96 and the parts of the wire 92 spanning the hanger 16 and the anchoring elements 82*a*,82*b* are constrained to bend about an axis running parallel to the longitudinal axis of the footrest 14.

The sleeve 96 at the longitudinal end 20*a* of the footrest 14 may be arranged so that the end of the sleeve 96 which receives the plug 94 butts the end portion 16*a* of the hanger 16 and the end of the sleeve 96 which receives the smaller cylindrical portion 86 of the anchoring element 82*a* butts the larger cylindrical portion 84 of the anchoring element 82*a*. Similarly, the sleeve 96 at the longitudinal end 20*b* of the footrest 14 may be arranged so that the end of the sleeve 96 which receives the plug 94 butts the end portion 16*b* of the hanger 16 and the end of the sleeve 96 which receives the smaller cylindrical portion 86 of the anchoring element 82*b* butts the larger cylindrical portion 84 of the anchoring element 82*b*. The sleeves 96 then bridge the hanger 16 and the anchoring elements 82*a*,82*b* on the footrest 14. The sleeves 96, the larger cylindrical portions 84 of the anchoring elements 82*a*,82*b* and the end portions 16*a*,16*b* of the hanger 16 can all have the same outer diameter so that a smooth transition from the footrest 14 to the hanger 16 exists at each of the longitudinal ends 20*a*,20*b* of the footrest 14.

The sleeves 96, which constitute cylindrical elements of circular cross section, may be made of material different from that of the footrest 14 and from that of the hanger 16. By way of example, the footrest 14 and the hanger 16 can be made of steel while the sleeves 96 are made of rubber.

Returning to FIGS. 5 and 6 in conjunction with FIG. 1, the shock-absorbing body 46 is provided with a recess or indentation 80*a* at the longitudinal end 48*a* of the shock-absorbing body 46 and with a recess or indentation 80*b* at the longitudinal end 48*b*. The recesses 80*a*;80*b* are centered transversely of the shock-absorbing body 46 and, when the shock-absorbing body 46 is properly placed on the footrest 14, the recess 80*a* receives the larger cylindrical portion 84 of the anchoring element 82*a* whereas the recess 80*b* receives the larger cylindrical portion 84 of the anchoring element 82*b*. The recesses 80*a*,80*b* help to position or align the shock-absorbing body 46 on the footrest 14 transversely of the latter and also serve to confine the shock-absorbing body 46 longitudinally of the footrest 14.

The longitudinal end 48*a* of the shock-absorbing body 46 is convex, as seen in a plan view, between the recess 80*a* and the respective sloping surface sections 62*a*,62*b* of the shock-absorbing body 46. Similarly, the longitudinal end 48*b* of the shock-absorbing body 46 is convex, as seen in a plan view, between the recess 80*b* and each of the sloping surface sections 62*a*,62*b*. Hence, the contours of the longitudinal ends 48*a*,48*b* of the shock-absorbing body 46 conform to the contours of the respective longitudinal ends 20*a*,20*b* of the footrest 14.

The shock-absorbing body 46, or at least the major part thereof, preferably comprises a body inflated with gas. This allows the shock-absorbing body 46 to function as a gas pad or cushion. The shock-absorbing body 46 can be made of plastic and the gas used to inflate the shock-absorbing body 46 may be air. In the illustrated embodiment, all of the shock-absorbing body 46 except for the crosspiece 74 is inflated with gas.

Referring to FIGS. 1, 2, 8 and 9, the stirrup 10 further comprises a nonslip tread or member 98 discrete from the footrest 14 and from the shock-absorbing body 46. The tread 98 includes an elongated sheet-like element or base 100 with opposite longitudinal ends 100*a* and 100*b* having rounded convex edges. The sheet-like element 100 is U-shaped as viewed on end and includes two spaced legs 102 and 104 which run longitudinally of the sheet-like element 100 and are connected to one another by a generally flat crosspiece 106. The sheet-like element 100 has a surface 108*a* which faces inward of the sheet-like element 100 and an opposed surface 108*b* which faces outward of the sheet-like 100. The inward facing surface 108*a* will here be referred to as the inner surface of the sheet-like element 100 while the outward facing surface 108*b* will be referred to as the outer surface of the sheet-like element 100.

The tread 98 is designed to rest on the shock-absorbing body 46 with the longitudinal end 100*a* of the sheet-like element 100 proximate to the longitudinal end 48*a* of the shock-absorbing body 46 and the longitudinal end 100*b* of the sheet-like element 100 proximate to the longitudinal end 48*b* of the shock-absorbing body 46. When the tread 98 is properly positioned on the shock-absorbing body 46, the inner surface 108*a* of the sheet-like element 100 is directed towards the shock-absorbing body 46. The length of the sheet-like element 100 is such that the inner surface 108*a* of the sheet-like element 100 can bear against the transverse surface section 64*a* at the longitudinal end 48*a* of the shock-absorbing body 46 and against the transverse surface section 64*b* at the longitudinal end 48*b* of the shock-absorbing body 46.

The leg 102 of the sheet-like element 100 has a straight flat section 102*a* which is spaced from the crosspiece 106 and lies in a plane normal to the plane of the crosspiece 106. The leg 102 further has a straight flat section 102*b* which bridges the crosspiece 106 and the flat section 102*a* and is sloped relative to the crosspiece 106 and the flat section 102*a*. The leg section 102*a* is designed to lie against the straight side 50*a* of the shock-absorbing body 46 whereas the leg section 102*b* is designed to lie against the sloping surface section 62*a* of the shock-absorbing body 46.

Similarly, the leg 104 of the sheet-like element 100 has a straight flat section 104*a* which is spaced from the crosspiece 106 and is located in a plane normal to the plane of the crosspiece 106. The leg 104 further has a straight flat section 104*b* which spans the crosspiece 106 and the flat section 104*a* and is sloped relative to the crosspiece 106 and the flat section 104*a*. The leg section 104*a* is designed to bear against the straight side 50*b* of the shock-absorbing body 46 whereas the leg section 104*b* is designed to bear against the sloping surface section 62*b* of the shock-absorbing body 46.

The sheet-like element 100 is formed with protrusions 110 which project to the outside of the sheet-like element 100 and cause the tread 98 to be nonslip. Each of the protrusions 110 has a fixed end which is connected to the sheet-like element 100, and each of the protrusions 110 further has a free end which faces away from the sheet-like element 100. The free end of each protrusion 110 is formed with a concavity or depression 110*a*.

The outer surface 108*b* of the sheet-like element 100 is arranged to support the foot of a rider employing the stirrup 10, and the protrusions 110 on the surface 108*b* inhibit the foot of the rider from slipping out of the stirrup 10. This effect is due, at least in part, to the concavities 110*a* in the protrusions 110.

The protrusions 110 can be made of a material having a relatively high coefficient of friction and a nonslip character.

The protrusions 110 may have any of a variety of configurations. By way of example, the protrusions 110 may be frustoconical. The concavities 110*a* in the protrusions 110 are here circular as seen in plan view, and each of the concavities 110*a* is advantageously centered with respect to the respective protrusion 110.

The inner surface 108*a* of the sheet-like element 100 is provided with two threaded studs or projections 112*a* and 112*b*. The studs 112*a*,112*b* are spaced from each other longitudinally of the tread 98 and are centered laterally of the tread 98.

Considering FIGS. 2 and 3, the footrest 14 is formed with two webs or strip-like elements 114 and 116 which are located in the opening 26 of the footrest 14. The webs 114,116 are spaced from one another longitudinally of the footrest 14 and bridge the strip-like sections 36*a*,36*b* thereof. The web 114 is provided with an opening or perforation 114*a* which is centered laterally and longitudinally of the web 114 while the web 116 is provided with an opening or perforation 116*a* which is centered laterally and longitudinally of the web 116. The openings 114*a*,116*a* are spaced from each other by the same distance as the studs 112*a*,112*b* on the tread 98. The opening 114*a* is arranged to be aligned with the aperture 76*a* of the shock-absorbing body 46 whereas the opening 116*a* is arranged to be aligned with the aperture 76*b*.

When the tread 98 is properly positioned on the footrest 14, the stud 112*a* extends through the aperture 76*a* of the shock-absorbing body 46 and through the opening 114*a* of the web 114. In a similar vein, the stud 112*b* passes through the aperture 76*b* of the shock-absorbing body 46 and through the opening 116*a* of the web 116. The studs 112*a*, 112*b* project to the side of the webs 114,116 remote from the shock-absorbing body 46, and the projecting portions of the studs 112*a*,112*b* are of such length that a washer 118 and a nut 120 may be placed on each of these projecting portions. A clamp 122 can be applied to each of the studs 112*a*,112*b* on the side of the respective nut 120 remote from the associated washer 118 to prevent loosening of the nut 120.

Upon tightening the nuts 120, the shock-absorbing body 46 is clamped between the tread 98 and the footrest 14. The tread 98 accordingly serves as an anchoring element for anchoring the shock-absorbing body 46 to the footrest 14.

The webs 114,116 of the footrest 14 can be referred to as anchoring members for the shock-absorbing body 46.

The shock-absorbing body 46, together with the tread 98, may be considered to constitute a nonslip article which inhibits the foot of a rider from slipping out of the stirrup 10.

One manner of assembling the stirrup 10 is as follows:

The hanger 16 with the wire 92 running therethrough is fabricated in a manner known per se as is the footrest 14 with the anchoring elements 82*a*,82*b*. Each of the anchoring elements 82*a*,82*b* is formed with a passage for a respective end portion 92*a* of the wire 92.

Before the end portions 92*a* of the wire 92 are inserted in the anchoring elements 82*a*,82*b*, one of the plugs 94 is placed on each end portion 92*a*. The plugs 94 are advanced to the respective end portions 16*a*,16*b* of the hanger 16 and pushed into the passage 90 of the hanger 16 so that part of each plug 94 is inside the passage 90 and part of each plug 94 is outside of the passage 90. The plugs 94 are made fast with the hanger 16 by a friction fit in the passage 90 and/or by bonding the plugs 90 to the hanger 16.

Once the plugs 94 are fast with the hanger 16, one of the sleeves 96 is placed on each of the end portions 92*a* of the wire 92. The sleeves 96 are pushed over the respective plugs 94 and into abutment with the respective end portions 16*a*,16*b* of the hanger 16. The sleeves 96 are made fast with the plugs 94 by a friction fit on the plugs 94 and/or by bonding the sleeves 96 to the plugs 94.

After the sleeves 96 have been made fast with the plugs 94, the smaller cylindrical portions 86 of the anchoring elements 82*a*,82*b* are pushed into the respective sleeves 96. As the anchoring elements 82*a*,82*b* advance into the sleeves 96, the end portions 92*a* of the wire 92 enter the passages in the respective anchoring elements 82*a*,82*b*. The anchoring elements 82*a*,82*b* continue to be pushed into the sleeves 96 until the larger cylindrical portions 84 of the anchoring elements 82*a*,82*b* abut the sleeves 96. The sleeves 96 are made fast with the anchoring elements 82*a*,82*b* by a friction fit on the smaller cylindrical portions 86 and/or by bonding the sleeves 96 to the anchoring elements 82*a*,82*b*. The end portions 92*a* of the wire 92 are likewise made fast with the anchoring elements 82*a*,82*b*. This can be accomplished by placing a bonding agent in the passages of the anchoring elements 82*a*,82*b* prior to insertion of the end portions 92*a* of the wire 92 in the passages. Alternatively, the end portions 92*a* of the wire 92 can be bonded to the anchoring elements 82*a*,82*b* by welding or brazing, for example. In such an event, the sleeves 96 are put in place after the end portions 92*a* have been connected to the anchoring elements 82*a*,82*b*. Thus, each of the sleeves 96 is then supplied as two semicylindrical sections which are butted and bonded to one another once the end portions 92*a* of the wire 92 have been secured to the anchoring elements 82*a*, 82*b*.

The shock-absorbing body 46 is now placed on the footrest 14. The shock-absorbing body 46 is positioned on the upper surface 24*a* of the footrest 14 with the depression 52 in the shock-absorbing body 46 facing the hanger 16 of the footrest 14. The lower surface section 66*a* of the shock-absorbing body 46 rests on the strip-like section 36*a* of the upper footrest surface 24*a* and the lower surface section 66*b* of the shock-absorbing body 46 rests on the strip-like section 36*b*. In addition, the lower surface section 68*a* of the shock-absorbing body 46 rests on the curved section 34*a* of the upper footrest surface 24*a* whereas the lower surface section 68*b* of the shock-absorbing body 46 rests on the curved section 34*b*.

The ribs 78*a*,78*b* of the shock-absorbing body 46 are inserted in the opening 26 of the footrest 14 with the rib 78*a* running alongside the wall segment 30*a* of the opening 26 and the rib 78*b* running alongside the wall segment 30*b*.

Moreover, the anchoring element 82*a* is introduced into the recess 80*a* of the shock-absorbing body 46 while the anchoring element 82*b* is introduced into the recess 80*b*. The ribs 78*a*,78*b* and the recesses 80*a*,80*b* serve to locate the shock-absorbing body 46 on the footrest 14. When the shock-absorbing body 46 is properly situated on the footrest 14, the aperture 76*a* of the shock-absorbing body 46 is aligned with the opening 114*a* in the web 114 of the footrest 14. Likewise, the aperture 76*b* of the shock-absorbing body 46 is aligned with the opening 116*a* in the web 116 of the footrest 14.

After the shock-absorbing body 46 has been placed on the footrest 14, the tread 98 is positioned with the stud 112*a* facing and in register with the aperture 76*a* of the shock-absorbing body 46 and with the stud 112*b* facing and in register with the aperture 76*b* of the shock-absorbing body 46. The studs 112*a*,112*b* are then passed through the respective apertures 76*a*,76*b* and into the openings 114*a*,116*a* of the respective webs 114,116 formed on the footrest 14. The studs 112*a*,112*b* are advanced until the sheet-like element 100 of the tread 98 rests against the shock-absorbing body 46. When the sheet-like element 100 bears against the shock-absorbing body 46, a portion of each stud 112*a*,112*b* projects to the side of the webs 114,116 remote from the shock-absorbing body 46.

The washers 118 are placed on the projecting portions of the studs 112*a*,112*b* and brought into abutment with the webs 114,116 of the footrest 14. Subsequently, the nuts 120 are screwed onto the studs 112*a*,112*b* and urged against the washers 118 thereby causing the shock-absorbing body 46 to be clamped between the footrest 14 and the tread 98. After the nuts 120 have been tightened, the clamps 122 are placed on the studs 112*a*,112*b* adjacent to the nuts 120 so as to inhibit loosening of the nuts 120.

To use the stirrup 10, a saddle is secured to an animal, such as a horse, which is suited for riding. A strap is passed through the slot 18 of the hanger 16 and attached to the saddle after which a rider places his or her foot on the tread 98 and swings into the saddle. Once the rider is in the saddle and urges the animal to move, the rider's foot tends to pivot back-and-forth. This tendency causes the footrest 14 to rotate or pivot elastically relative to the hanger 16 on an axis which is parallel to the longitudinal axis of the footrest 14.

FIGS. 11-14 illustrate another embodiment of a stirrup in accordance with the invention.

Figure 11:
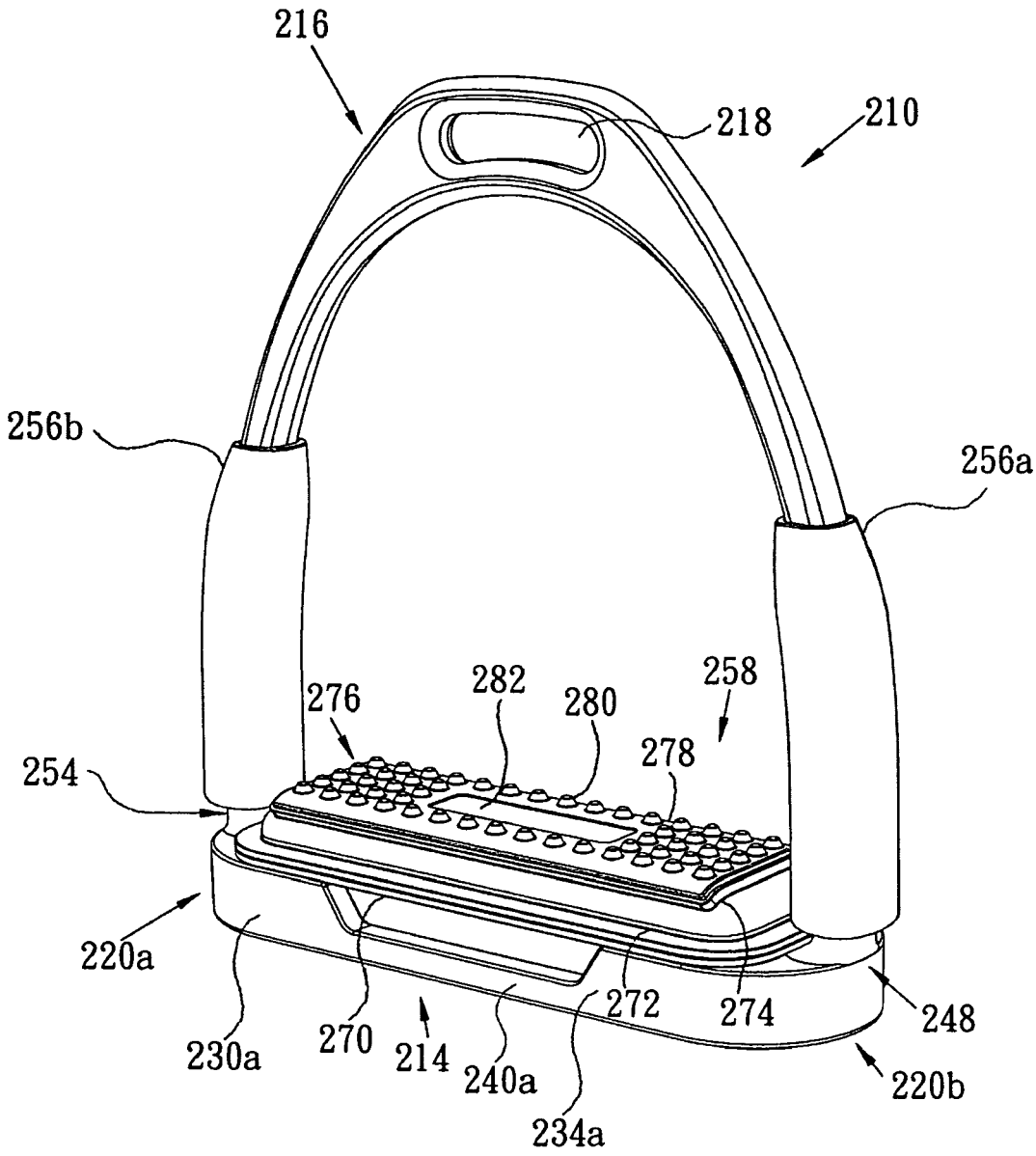
FIG. 11 is a perspective view of another embodiment of a stirrup which is designed in accordance with the invention and includes a footrest, a shock-absorbing body on the footrest and a nonslip tread overlying the shock-absorbing body.
Figure 12:
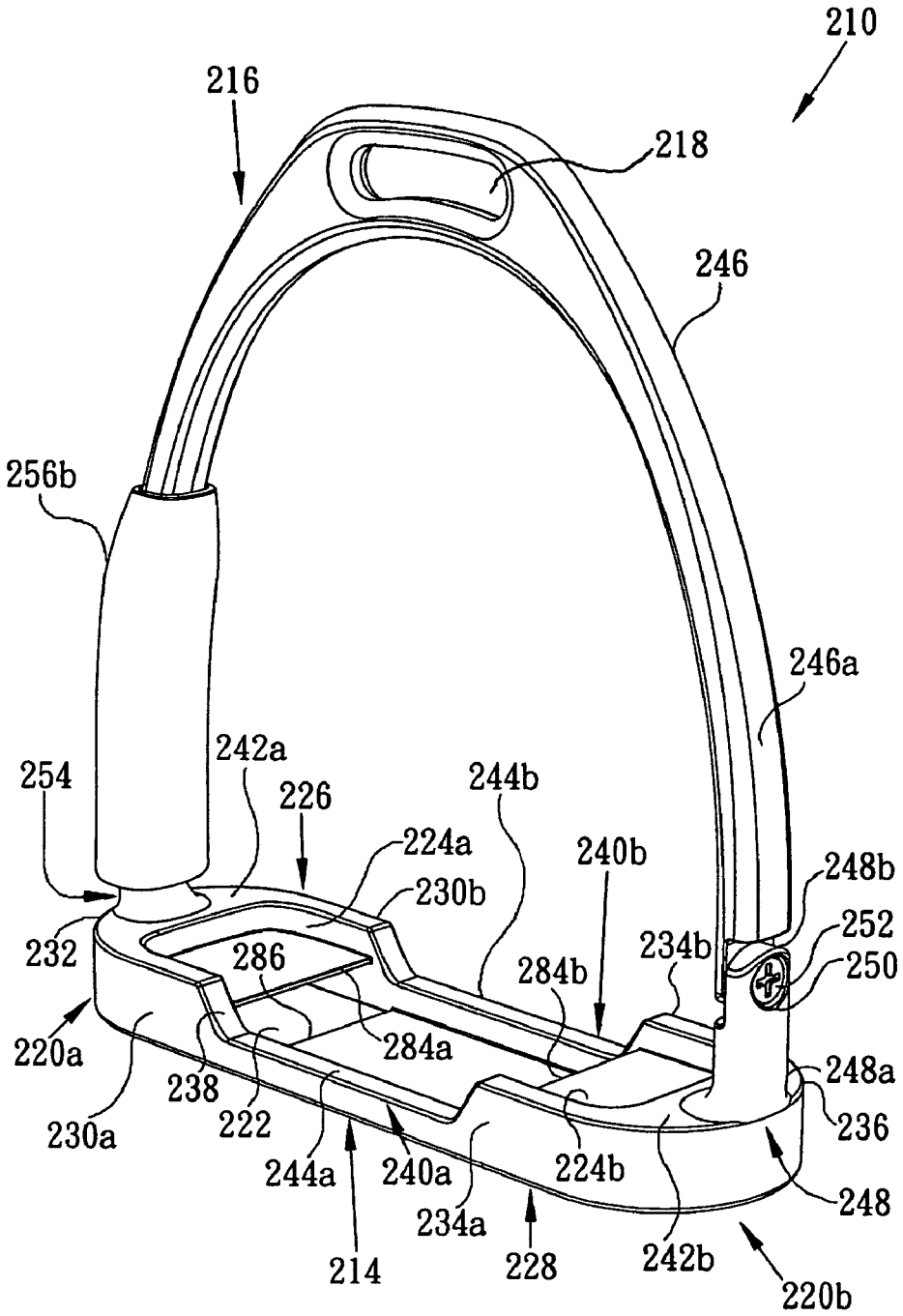
FIG. 12 is a perspective view of the stirrup of FIG. 1 with the shock-absorbing body, the nonslip tread and a sleeve forming part of the stirrup removed.

In FIGS. 11 and 12, the stirrup is identified by the numeral 210. The stirrup 210 includes a rigid metallic footrest 214 which constitutes a support for a foot and a U-shaped, rigid metallic hanger or suspending element 216 which serves to suspend the stirrup 210 from an animal such as a horse, e.g., from a saddle mounted on an animal. The hanger 216, which is centered with respect to the footrest 214 laterally of the latter, is provided with a slot 218 for attaching the hanger 216 to the animal. Unlike the hanger 16 of the stirrup 10 which is provided with a passage 90 for the wire 92, the hanger 216 of the stirrup 210 has a solid cross section throughout except for the portion of the hanger 216 containing the slot 218.

The footrest 214 is elongated and has opposed longitudinal ends 220*a* and 220*b*. The footrest 214 is formed with an opening 222 which is elongated in the same direction, and has approximately the same shape, as the footrest 214. The opening 222, which is centered laterally and longitudinally of the footrest 214, has opposed longitudinal ends 224*a* and 224*b*.

The longitudinal ends 220*a*,220*b* of the footrest 214 are U-shaped as seen in a plan view of the footrest 214, and the longitudinal ends 220*a*,220*b* of the footrest 214 respectively accommodate the longitudinal ends 224*a*,224*b* of the opening 222.

The footrest 214 has a side 226 which faces up during use and an opposite side 228 which faces down during use. The side 226 may thus be referred to as the upper side of the footrest 214 whereas the side 228 may be referred to as the lower side of the footrest 214.

The U-shaped longitudinal end 220*a* of the footrest 214 has two legs 230*a* and 230*b* as well as a crosspiece 232 which bridges the legs 230*a*,230*b*. Similarly, the U-shaped longitudinal end 220*b* of the footrest 214 has two legs 234*a* and 234*b* plus a crosspiece 236 which bridges the legs 234*a*,234*b*. The leg 230*a* of the longitudinal end 220*a* and the leg 234*a* of the longitudinal end 220*b* are aligned with one another longitudinally of the footrest 214 and are spaced from each other. The same is true for the leg 230*b* of the longitudinal end 220*a* and the leg 234*b* of the longitudinal end 220*b*.

Each of the legs 230*a*,230*b*,234*a*,234*b* has an end face 238 which extends from the upper side 226 of the footrest 214 partway to the lower side 228. The end face 238 of the leg 230*a* and the end face 238 of the longitudinally aligned leg 234*a* are bridged by a bar 240*a* forming part of the footrest 214 while the end face 238 of the leg 230*b* and the end face 238 of the longitudinally aligned leg 234*b* are bridged by a bar 240*b* also forming part of the footrest 214. The bars 240*a*,240*b*, which have a smaller thickness than the longitudinal ends 220*a*,220*b* of the footrest 214, are parallel to one another.

The longitudinal ends 220*a*,220*b* of the footrest 214 have respective upper surfaces 242*a* and 242*b* which are flat and lie in a common plane. The lower side 228 of the footrest 214 is likewise flat and defines a plane which is parallel to the plane of the upper surfaces 242*a*,242*b*. The bars 240*a*, 240*b* of the footrest 214 have respective upper surfaces 244*a* and 244*b* which are also flat and are again located in a common plane. The plane of the upper surfaces 244*a*,244*b* of the bars 240*a*,240*b* is parallel to, and located between, the plane of the lower side 228 of the footrest 214 and the plane of the upper surfaces 242*a*,242*b* of the longitudinal ends 220*a*,220*b* of the footrest 214.

The footrest 214 and the hanger 216 constitute two separate components which are connected to each other such that the footrest 214 and the hanger 216 can move relative to one another. More particularly, the footrest 214 and the hanger 216 are rotatable or pivotable with respect to each other on an axis which runs in the direction of elongation, and is parallel to the longitudinal axis, of the footrest 214.

The hanger 216 has two end portions and a U-shaped main portion 246 which bridges the end portions. Only one end portion of the hanger 216 is visible in the drawings. The non-visible end portion of the hanger 216 confronts the longitudinal end 220*a* of the footrest 214 while the visible end portion of the hanger 216, seen in FIG. 12, confronts the longitudinal end 220*b* of the footrest 214. The footrest 214 is connected to the end portions of the hanger 216 and the same connection is used at each of these end portions. This connection will be described with reference to the visible end portion of the hanger 216.

Considering FIG. 12, the visible end portion of the hanger 216 is denoted by the numeral 246*a*. The cross section of the end portion 246*a* of the hanger 216 is smaller than the cross section of the main portion 246 of the hanger 216, and the end portion 246*a* is in the form of a flat tongue or tab which projects from the main portion 246 axially thereof. The end portion 246*a* confronts the longitudinal end 220*b* of the footrest 214 as mentioned previously and is spaced from the longitudinal end 220*b*.

An anchoring element 248 is mounted on the upper surface 242*b* of the longitudinal end 220*b* of the footrest 214. The anchoring element 248 is situated on the crosspiece 236 of the longitudinal end 220*b* and is centered with respect to the legs 234*a*,234*b* of the longitudinal end 220*b*. The anchoring element 248 comprises a pedestal or base 248*a* which sits on the longitudinal end 220*b* of the footrest 214, and the anchoring element 248 further comprises a bearing member 248*b* which is supported by the pedestal 248*a* at an end of the pedestal 248*a* remote from the longitudinal end 220*b*. The bearing member 248*b* has a cross section which is smaller than that of the pedestal 248*a*.

The bearing member 248*b* of the anchoring element 248 is located adjacent to and faces the end portion 246*a* of the hanger 216. The bearing member 248*b* is provided with a passage 250 which registers with a non-illustrated passage in the end portion 246*a* of the hanger 216. A pivot pin or bearing element 252 is mounted in the passage 250 of the bearing member 248*b* and the registering passage of the end portion 246*a*, and the pivot pin 252 pivotally connects the end portion 246*a* and the bearing member 248*b* to one another.

The axis of the pivot pin 252 extends in the direction of elongation, and is parallel to the longitudinal axis, of the footrest 214. Furthermore, the pivot pin 252 is coaxial with a non-illustrated pivot pin connecting the non-visible end portion of the hanger 216 to an anchoring element 254 on the longitudinal end 220*a* of the footrest 214. Consequently, the footrest 214 and the hanger 216 are pivotable or rotatable relative to one another on an axis extending in the direction of elongation, and paralleling the longitudinal axis, of the footrest 214.

Referring to FIG. 11 in conjunction with FIG. 12, the joint formed by the pivot pin 252, the end portion 246*a* of the hanger 216 and the bearing member 248*b* of the anchoring element 248 is surrounded by a sleeve or housing 256*a* which functions to protect the joint. One end of the sleeve 256*a* sits on the pedestal 248*a* of the anchoring element 248 while the other end of the sleeve 256*a* sits on the main portion 246 of the hanger 216 at a location between the slot 218 and the pivot pin 252.

A sleeve or housing 256*b* similar to the sleeve 256*a* surrounds the joint formed between the footrest 214 and the hanger 216 at the longitudinal end 220*a* of the footrest 214.

The sleeves 256*a*,256*b* are flexible or elastic thereby allowing the sleeves 256*a*,256*b* to bend as the footrest 214 and the hanger 216 pivot relative to one another. By way of example, the sleeves 256*a*,256*b* can be made of rubber.

Figure 13:
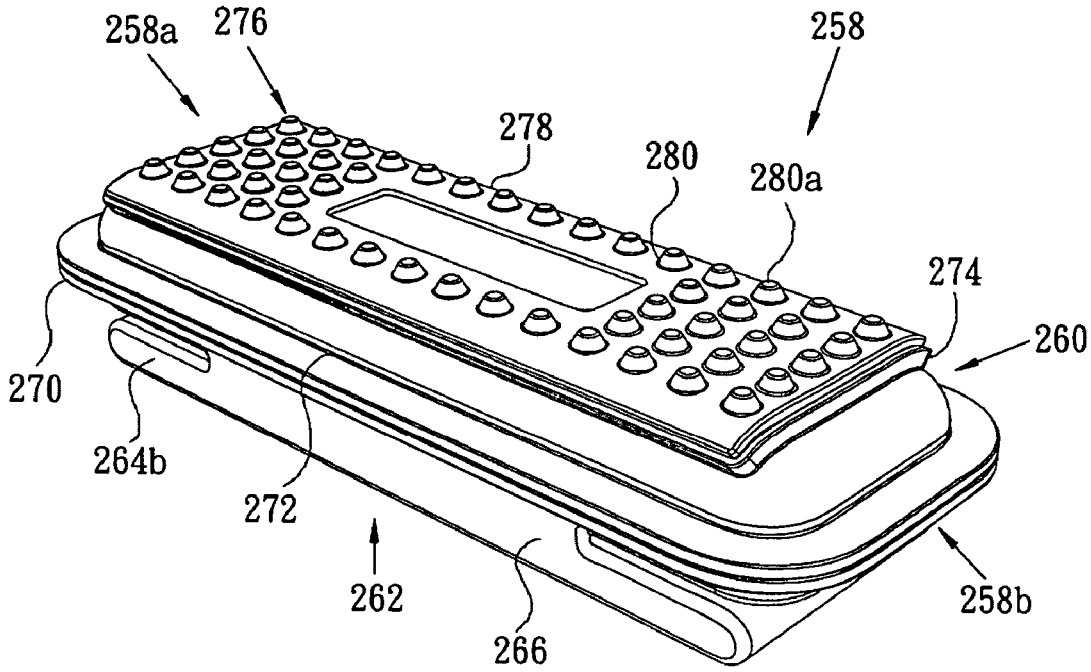
FIG. 13 is a perspective view of the shock-absorbing body and nonslip tread of the stirrup of FIG. 11.
Figure 14:
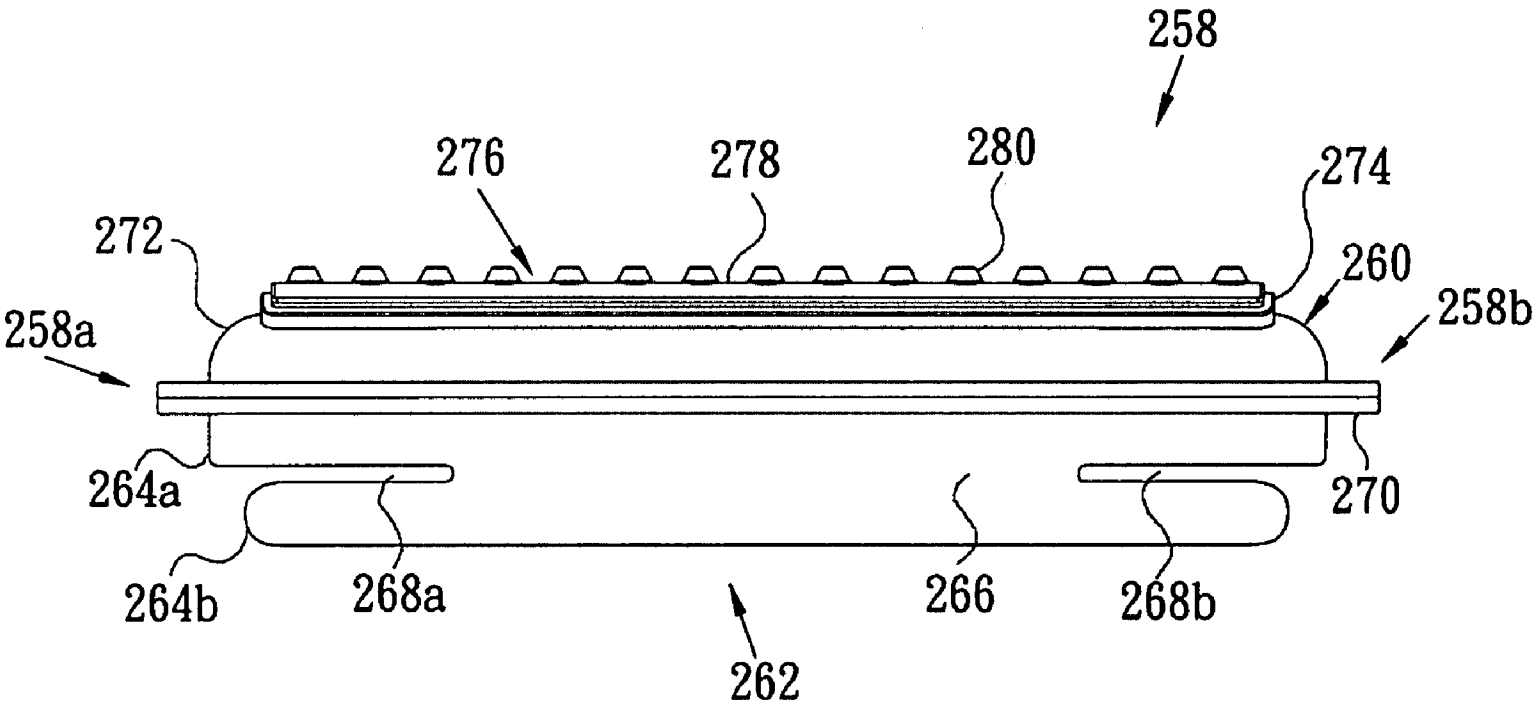
FIG. 14 is a side view of the shock-absorbing body and nonslip tread of the stirrup of FIG. 11.

Considering FIGS. 11, 13 and 14, the stirrup 210 additionally includes a nonslip article 258 which is discrete from and anchored to the footrest 214. The nonslip article 258 is elongated and has opposed longitudinal ends 258*a* and 258*b*.

The nonslip article 258 includes an elongated body 260 which serves as a shock-absorbing or cushioning element for the foot of a rider and also functions to anchor the nonslip article 258 to the footrest 214. The shock-absorbing body 260 defines one or more substantially leakproof chambers containing gas, and the shock-absorbing body 260 is designed in such a manner that at least the major part of the nonslip article 258 is inflated with gas. The gas used to inflate the shock-absorbing body 260 is preferably air.

The shock-absorbing body 260 includes a section 262 which is used to anchor the nonslip article 258 to, and to position the nonslip article 258 on, the footrest 214. As best seen in the side view of FIG. 14, this anchoring and positioning section 262 comprises two layers 264*a* and 264*b* which are joined to one another by a relatively thin neck or constriction 266. The neck 266 is centered lengthwise of the layers 264*a*,264*b* and has a length less than that of either layer 264*a*,264*b*. Thus, a portion of each layer 264*a*,264*b* projects to one side of the neck 266 and another portion of each layer 264*a*,264*b* projects to the other side of the neck 266. The projecting portions of the layers 264*a*,264*b* on the one side of the neck 266 define a slot or space 268*a* at the longitudinal end 258*a* of the nonslip article 258 while the projecting portions of the layers 264*a*,264*b* on the other side of the neck 266 define a slot or space 268*b* at the longitudinal end 258*b* of the nonslip article 258. The slot 268*a* opens to the sides and to the longitudinal end 258*a* of the nonslip article 258 whereas the slot 268*b* opens to the sides and to the longitudinal end 258*b* of the nonslip article 258. The slots 268*a*,268*b* are planar and are located in a common plane.

The contours of the layers 264*a*,264*b* of the shock-absorbing body 260 are at least approximately the same as the contour of the opening 222 in the footrest 214. When the nonslip article 258 is properly positioned on the footrest 214, the layers 264*a*,264*b* of the shock-absorbing body 260 are located in the opening 222 of the footrest 214 with the layer 264*a* above the layer 264*b*. As illustrated in FIG. 14, the length of the upper layer 264*a* is somewhat greater than the length of the lower layer 264*b*, and the length of the upper layer 264*a* is selected in such a manner that the upper layer 264*a* fits snugly in the opening 222 of the footrest 214 lengthwise of the opening 222. On the other hand, the upper layer 264*a* and the lower layer 264*b* have the same width and this width is chosen so that both the upper layer 264*a* and the lower layer 264*b* fit snugly in the opening 222 widthwise of the latter.

Referring once again to FIG. 13 in conjunction with FIG. 14, the shock-absorbing body 260 further includes a section 270 which adjoins the upper layer 264*a*. The section 270 is in the form of a generally flat rim or flange which is circumferentially complete, that is, which extends along the entire periphery of the shock-absorbing body 260. The rim 270, which has a contour resembling that of the opening 222 in the footrest 214, is designed to rest on the upper surfaces 242*a*,242*b* of the footrest 214 when the nonslip article 258 is properly situated on the footrest 214. To this end, the length of the rim 270 exceeds the length of the opening 222 in the footrest 214 and is equal to or less than the distance between the anchoring element 248 at the longitudinal end 220*b* of the footrest 214 and the anchoring element 254 at the longitudinal end 220*a*. The width of the rim 270 is greater than the width of the opening 222 and preferably does not exceed the width of the footrest 214.

The shock-absorbing body 260 additionally includes a section 272 which projects to the side of the rim 270 remote from the layers 264*a*,264*b* of the shock-absorbing body 260. The projecting section 272, which again has a contour similar to that of the opening 222 in the footrest 214, has the same, or approximately the same, dimensions as the upper layer 264*a* of the shock-absorbing body 260. When the stirrup 210 is in use and the nonslip article 258 is in proper position on the footrest 214, the projecting section 272 of the shock-absorbing body 260 sits above the upper surfaces 242*a*,242*b* of the footrest 214.

The projecting section 272 of the shock-absorbing body 260 has a side which faces away from the rim 270 and is normally directed upward during use, and a generally rectangular sheet-like support 274 is secured to this side of the projecting section 272. The sheet-like support 274, which has smaller dimensions than the projecting section 272, serves as a carrier for a nonslip tread or member 276.

The tread 276 comprises a generally rectangular sheet-like support or base 278 which is preferably flexible or resilient and has approximately the same dimensions as the sheet-like carrier 274. The sheet-like element 278 has a major surface which faces away from the sheet-like carrier 274 and is normally directed upward when the stirrup 210 is in use and the nonslip article 258 is properly situated on the footrest 214. Such surface is provided with a multiplicity of protrusions 280 which are intended to bear against the boot sole of a rider employing the stirrup 210, and each of the protrusions 280 has a fixed end which is connected to this surface of the sheet-like element 278. Each of the protrusions 280 further has a free end which faces away from the sheet-like element 278, and the free end of each protrusion 280 is formed with a concavity or depression 280*a*. The protrusions 280 inhibit the foot of the rider from slipping out of the stirrup 210 and this effect is due, at least in part, to the concavities 280*a* in the protrusions 280. In particular, the resilience of the material making up the protrusions 280 in combination with the concavities 280*a* produce a suction effect upon any surface bearing upon them, thereby further increasing the gripping performance of the nonslip article 258 of the invention. Because of the relatively small size of the protrusions 280 (preferably about 2.5 mm at the top edge), they can adhere to and therefore act as a suction cup even on relatively non-uniform surfaces, such as the typical soles of riding boots.

The protrusions 280 are preferably composed of a flexible or resilient material having a relatively high coefficient of friction and a nonslip character. For instance, the protrusions 280 can be made of rubber. The protrusions 280 may be integral with the sheet-like element 278.

The protrusions 280 may have any of a variety of configurations. For instance, the protrusions 280 may be frustoconical as illustrated in FIGS. 13 and 14. The concavities 280*a* in the protrusions 280 are here circular as seen in plan view, and each of the concavities 280*a* is advantageously centered with respect to the respective protrusion 280.

The tread 276 may be releasably attached to the sheet-like carrier 274, e.g., by way of hook-and-loop fastening means. Releasable attachment of the tread 276 to the sheet-like carrier 274 enables the tread 276 to be replaced when the tread 276 becomes worn or damaged.

The tread 276 is provided with a generally rectangular cutout 282 which exposes a portion of the underlying sheet-like carrier 274. Such portion of the sheet-like carrier 274 can be provided with one or more indicia forming a logo or a legend, for example.

Returning to FIG. 12, the longitudinal end 224*a* of the opening 222 in the footrest 214 accommodates a platform or crosspiece 284*a* while the longitudinal end 224*b* of the opening 222 accommodates a platform or crosspiece 284*b*. The platforms 284*a*,284*b*, which are flat and sheet-like, lie in a common plane located between the plane of the lower side 228 of the footrest 214 and the plane of the upper surfaces 242*a*,242*b* of the footrest 214. The platform 284*a* is fixed to the legs 230*a*,230*b* and the crosspiece 232 of the longitudinal end 220*a* of the footrest 214 whereas the platform 284*b* is fixed to the legs 234*a*,234*b* and the crosspiece 236 of the longitudinal end 220*b* of the footrest 214.

The platforms 284*a*,284*b* serve as anchoring members for fixing the nonslip article 258 on the footrest 14.

Another platform or crosspiece 286 is disposed in the opening 222 of the footrest 214 and is centered longitudinally of the opening 222. The platform 286 is again flat and sheet-like, and the platform 286 is parallel to the plane of the platforms 284*a*,284*b* and is located on the side of such plane remote from the upper surfaces 242*a*,242*b* of the footrest 214. The platform 286 is preferably positioned so that the surface thereof which faces away from the upper surfaces 242*a*,242*b* of the footrest 214 is coplanar with the lower side 228 of the footrest 214. The platform 286, which functions as a rest or supporting member for the nonslip article 258, is fixed to the bars 240*a*,240*b* bridging the longitudinal ends 220*a*,220*b* of the footrest 214.

The nonslip article 258 is flexible so that the nonslip article 258 can be bent in order to mount the nonslip article 258 on the footrest 214. One manner of mounting the nonslip article 258 on the footrest 214 is to place the longitudinal end 258*a* of the nonslip article 258 between the bars 240*a*,240*b* of the footrest 214. The longitudinal end 258*a* is positioned with an adjoining portion of the lower layer 264*b* of the nonslip article 258 bearing against the rest 286 of the footrest 214 and with the slot 268*a* of the nonslip article 258 facing the anchoring member 284*a* of the footrest 214. The nonslip article 258 can then be slid towards the anchoring member 284*a* thereby allowing the latter to enter the slot 268*a*. Once the anchoring member 284*a* is received in the slot 268*a*, the nonslip article 258 can be bent in a manner which permits the other anchoring member 284*b* of the footrest 214 to enter the slot 268*b* of the nonslip article 258.

As indicated earlier, the lower layer 264*b* of the nonslip article 258 is somewhat shorter than the upper layer 264*a*. This makes it easier to insert one of the anchoring members 284*a*,284*b* of the footrest 214 in the respective slot 268*a*, 268*b* of the nonslip article 258 after the other anchoring member 284*a*,284*b* has been received in the corresponding slot 268*a*,268*b*.

The nonslip article 258 can be readily removed from the footrest 214 by pulling the central portion of the nonslip article 258 away from the footrest 214. This action will cause the slots 268*a*,268*b* of the nonslip article 258 to retract from the respective anchoring members 284*a*,284*b* of the footrest 214. Release of the nonslip article 258 from the footrest 214 is facilitated by the fact that the lower layer 264*b* of the nonslip article 258 is shorter than the upper layer 264*a*.

When the nonslip article 258 is properly anchored to the footrest 214, the anchoring members 284*a*,284*b* are in the respective slots 268*a*,268*b*. The upper layer 264*a* and the lower layer 264*b* of the nonslip article 258 are located in the opening 222 of the footrest 214 with the lower layer 264*b* bearing against the rest 286 of the footrest 214. The rim 270 of the nonslip article 258 rests on the upper surfaces 242*a*, 242*b* of the respective longitudinal ends 220,220*b* of the footrest 214.

As seen in FIG. 11, a gap is present between the rim 270 of the nonslip article 258 and the bar 240*a* of the footrest 214. A similar gap is present between the rim 270 and the opposite bar 240*b* of the footrest 214. These gaps, which exist because the bars 240*a*,240*b* are thinner than the longitudinal ends 220*a*,220*b* of the footrest 214 on which the rim 270 sits, make it easier to grip the nonslip article 258 for removal from the footrest 214.

FIGS. 15-23 illustrate an additional embodiment of a stirrup according to the invention.

Figure 15:
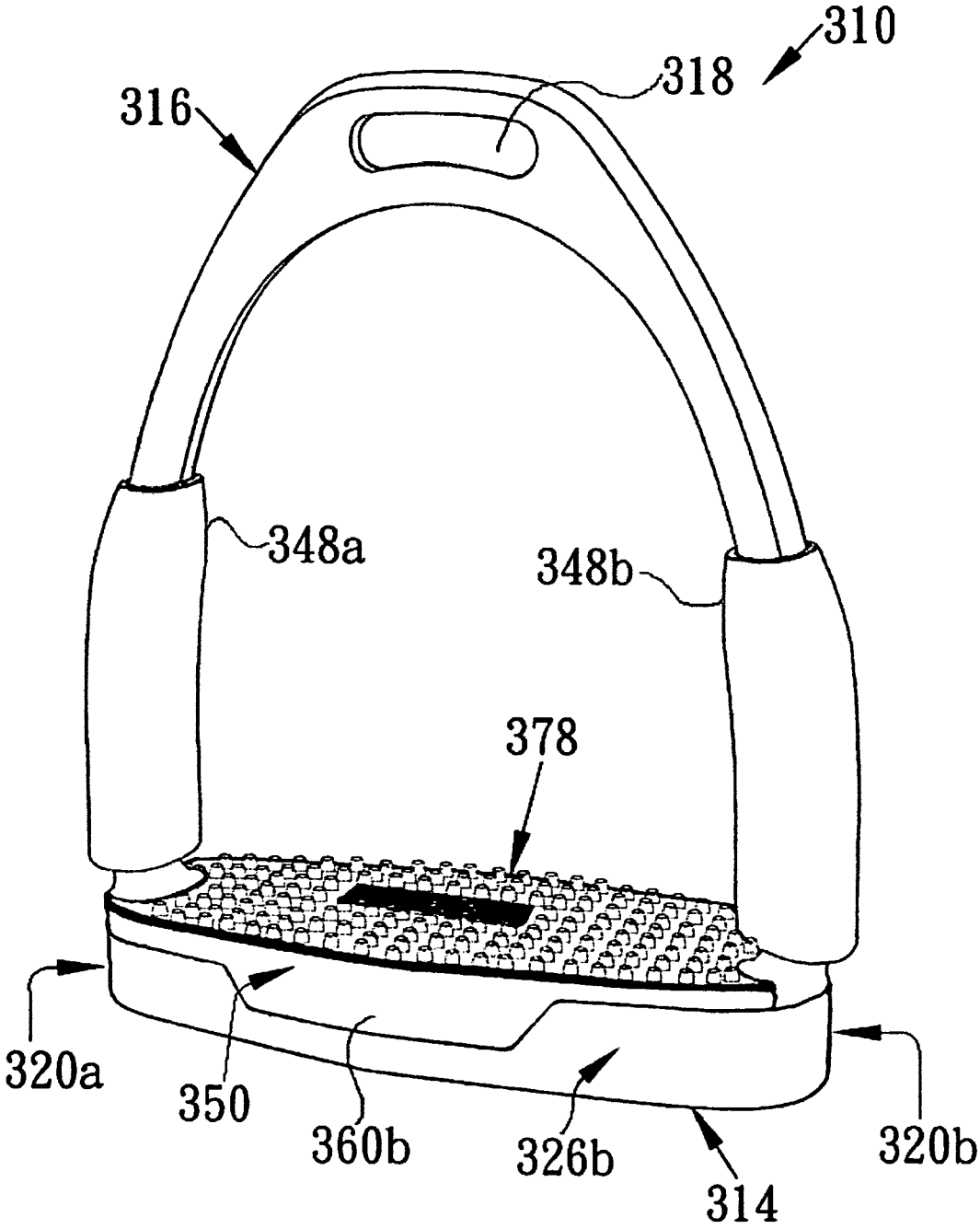
FIG. 15 is a top perspective view of another embodiment of a stirrup which is designed in accordance with the invention and includes a footrest, a shock-absorbing body on the footrest and a nonslip tread overlying the shock-absorbing body.
Figure 16:
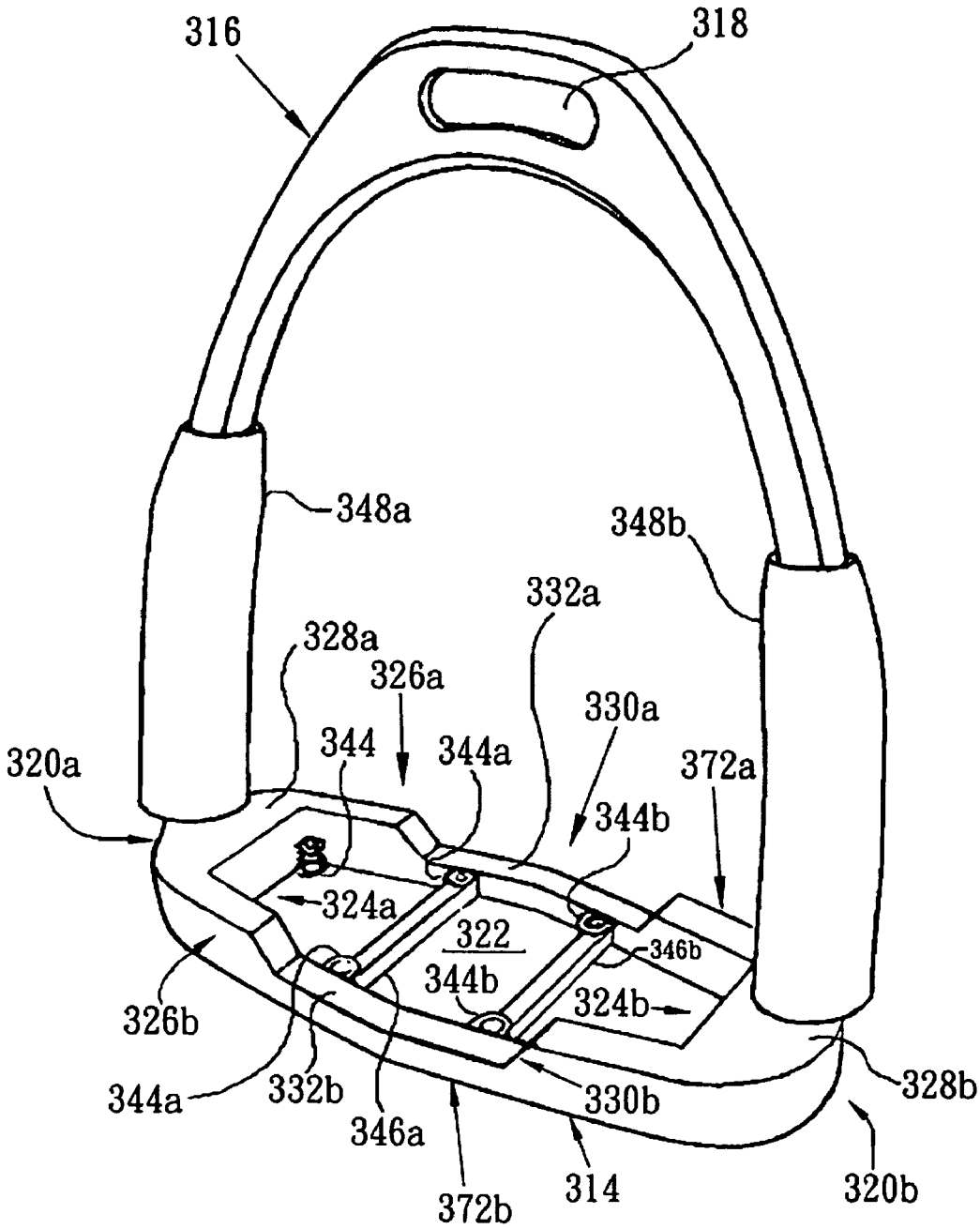
FIG. 16 is a perspective view of the stirrup of FIG. 15 with the shock-absorbing body, the nonslip tread and a sleeve forming part of the stirrup removed.

Turning to FIGS. 15 and 16, the stirrup is identified by the numeral 310. The stirrup 310 comprises a rigid metallic footrest 314 which constitutes a support for a foot and a U-shaped, rigid metallic hanger or suspending element 316 which serves to suspend the stirrup 310 from an animal such as a horse, e.g., from a saddle mounted on an animal. The hanger 316, which is centered with respect to the footrest 314 laterally of the latter, is provided with a slot 318 for attaching the hanger 316 to the animal. Similarly to the hanger 216 of the stirrup 210, the hanger 316 of the stirrup 310 has a solid cross section throughout except for the portion of the hanger 316 containing the slot 318.

The footrest 314 is elongated and has opposed longitudinal ends 320*a* and 320*b*. The footrest 314 is formed with an opening 322 which is elongated in the same direction, and has approximately the same shape or outline, as the footrest 314. The opening 322, which is centered laterally and longitudinally of the footrest 314, has opposed longitudinal ends 324*a* and 324*b* which respectively adjoin the longitudinal ends 320*a*,320*b* of the footrest 314.

The footrest 314 comprises a peripheral wall which circumscribes the opening 322. The peripheral wall includes a pair of strip-like side bars or lateral wall sections 326*a* and 326*b* which are spaced from each other transversely of the footrest 314 and extend from one of the longitudinal ends 320*a*,320*b* of the footrest 314 to the other. The peripheral wall further includes a crosspiece or end wall section 328*a* at the longitudinal end 320*a* of the footrest 314 and a crosspiece or end wall section 328*b* at the longitudinal end 320*b* of the footrest 314. Each of the crosspieces 328*a*,328*b* bridges the side bars 326*a*,326*b* of the peripheral wall and connects the side bars 326*a*,326*b* to one another. The side bar 326*a* and the side bar 326*b* diverge from the crosspiece 328*a* to a location midway between the crosspieces 328*a*, 328*b*. The side bar 326*a* and the side bar 326*b* then converge from this location to the crosspiece 328*b*. Accordingly, the opening 322 widens progressively from the crosspiece 328*a* to a location midway between the crosspieces 328*a*,328*b* and thereafter narrows progressively to the crosspiece 328*b*.

The side bar 326*a* of the footrest 314 is formed with a cutout 330*a* while the side bar 326*b* is formed with a cutout 330*b* which is in register with the cutout 330*a*. The cutouts 330*a*,330*b* are centered longitudinally of the footrest 314.

The cutout 330*a* is bounded by a pair of planar, sloping surfaces and a flat surface 332*a* which bridges the sloping surfaces. Likewise, the cutout 330*b* is bounded by a pair of planar, sloping surfaces as well as a flat surface 332*b* which bridges such sloping surfaces and is coplanar with the flat surface 332*a*. The sloping surfaces and flat surfaces 332*a*, 332*b* of the cutouts 330*a*,330*b* are arranged so that the cutouts 330*a*,330*b* have an approximately trapezoidal configuration as seen in a side view. The cutouts 330*a*,330*b* open towards the hanger 316.

Figure 17:
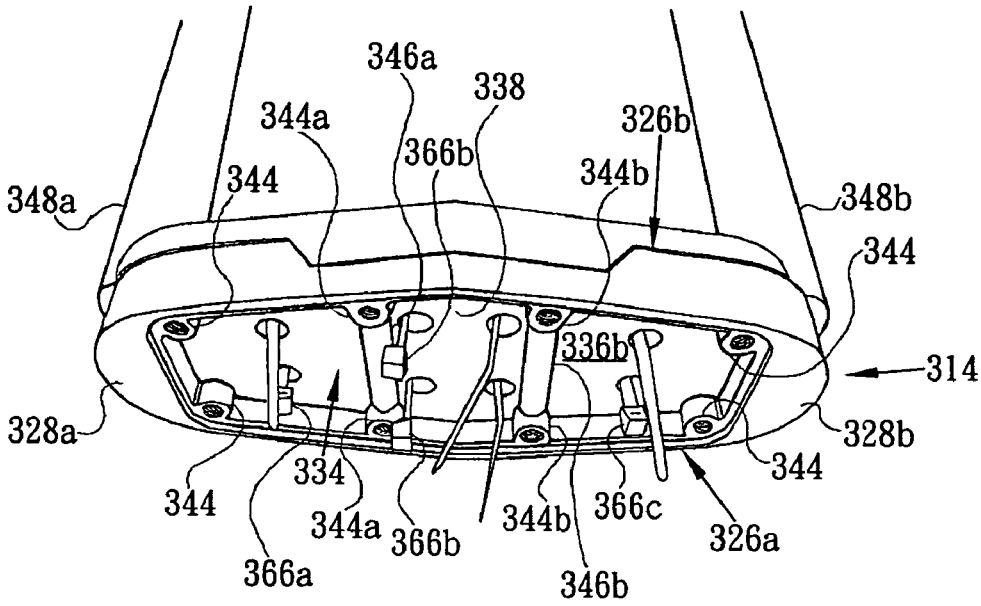
FIG. 17 is a fragmentary bottom perspective view of the stirrup of FIG. 15.
Figure 18:
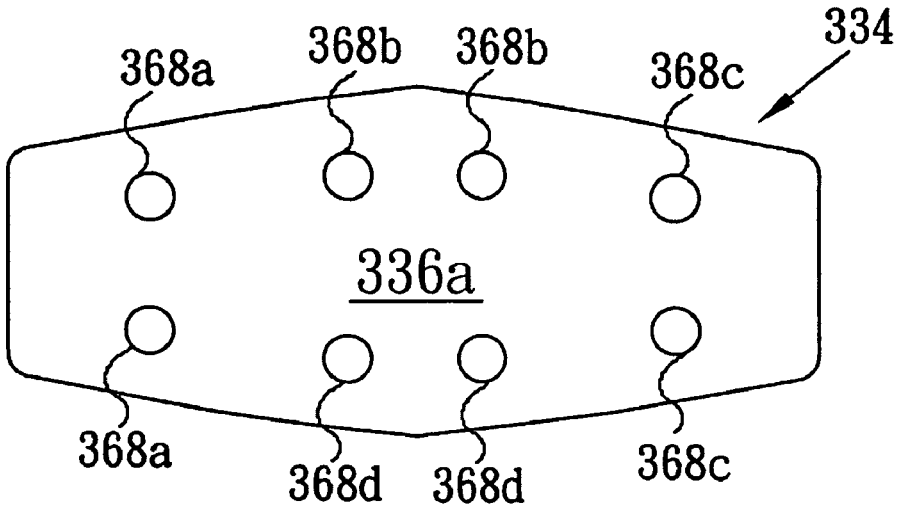
FIG. 18 is a top view of a supporting plate forming part of the footrest of the stirrup of FIG. 15.

Considering FIGS. 17 and 18 in conjunction with FIG. 16, the footrest 314 has a side 372*a* which faces the hanger 316 and hence faces up during use. The footrest 314 also has an opposite side 372*b* which faces down during use, and the side 372*a* may be referred to as the upper side of the footrest 314 while the side 372*b* may be referred to as the lower side of the footrest 314. A plate or plate-like member 334 is mounted on the footrest 314 and is located in the opening 322 between the upper side 372*a* and the lower side 372*b* of the footrest 314. The plate 334 has essentially the same shape or outline, and essentially the same area or dimensions, as the opening 322 and is fixed to the peripheral wall 326*a*,326*b*,328*a*,328*b* of the footrest 314. The plate 334 is advantageously secured to the peripheral wall 326*a*,326*b*, 328*a*,328*b* by fusional bonds, that is, bonds formed by fusion or melting. Examples of such bonds are those produced by welding, brazing or soldering.

The plate 334 has a planar major side or surface 336*a* which faces the hanger 316 and thus faces up during use. This major side or surface 336*a* of the plate 334, which can be considered an upper major side or surface of the plate 334, is preferably coplanar or nearly coplanar with the flat surfaces 332*a*,332*b* of the cutouts 330*a*,330*b*.

The plate 334 further has a planar major side or surface 336*b* which is located opposite the upper major side 336*a* and faces down during use. Such major side or surface 336*b* of the plate 334, which can be considered a lower major side or surface of the plate 334, is spaced from the lower side 332*b* of the footrest 314 and accordingly lies above the lower side 332*b* during use. The plate 334 cooperates with the portion of the peripheral wall 326*a*,326*b*,328*a*,328*b* located between the lower major side 336*b* of the plate 334 and the lower side 332*b* of the footrest 314 to define a cavity or space 338. The cavity 338 is located to an opposite side of the plate 334 from the hanger 316.

Figure 19:
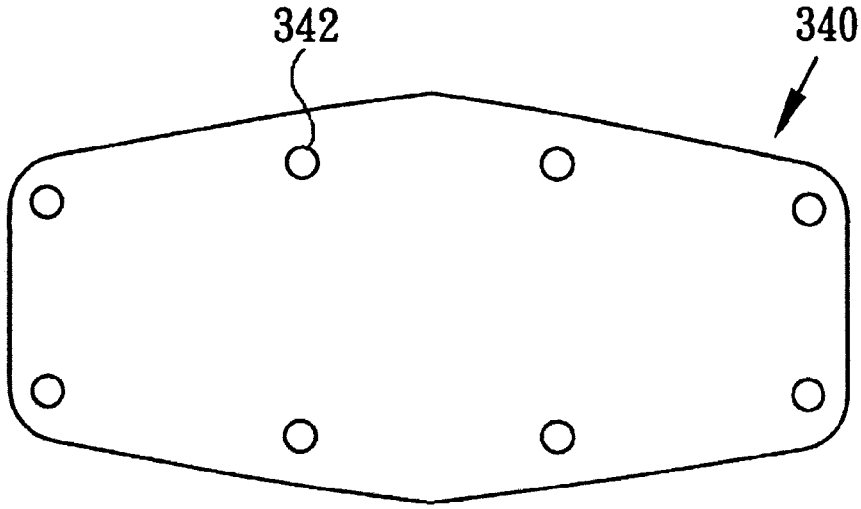
FIG. 19 is a top view of a cover constituting part of the footrest of the stirrup of FIG. 15.

Referring to FIG. 19 together with FIGS. 16 and 17, a cover 340 is provided for the cavity 338. The cover 340, which is here in the form of a flat plate, is designed to fit in the opening 322 of the footrest 314. The cover 340 has approximately the same shape or outline, and approximately the same area or dimensions, as the opening 322 and is formed with a series of perforations 342 near the periphery thereof. The perforations 342 constitute a means for releasably securing the cover 340 to the plate 334 and the peripheral wall 326*a*,326*b*,328*a*,328*b*, i.e., the perforations 342 constitute a means for securing the cover 340 to the plate 334 and the peripheral wall 326*a*,326*b*,328*a*,328*b* and for permitting release of the cover 340 from the plate 334 and the peripheral wall 326*a*,326*b*,328*a*,328*b* without damage to the cover 340, the plate 334 or the peripheral wall 326*a*,326*b*,328*a*,328*b*.

A series of mounting elements 344, 344*a* and 344*b* is disposed in the cavity 338 of the footrest 314, and the number of mounting elements 344,344*a*,344*b* equals the number of perforations 342 in the cover 340. In the illustrated embodiment, the cover 340 is formed with eight perforations 342 and, correspondingly, four mounting elements 344, two mounting elements 344*a* and two mounting elements 344*b* are located in the cavity 338 of the footrest 314. The mounting elements 344,344*a*,344*b* are arranged in the same pattern as the perforations 342 in the cover 340. Accordingly, when the cover 340 is properly positioned in the opening 322 of the footrest 314, each of the perforations 342 registers with one of the mounting elements 344,344*a*, 344*b*.

The mounting elements 344,344*a*,344*b* are here in the form of cylinders of generally circular cross section, and each of the mounting elements 344,344*a*,344*b* is provided with a threaded passage extending axially of the respective mounting element 344,344*a*,344*b*. After the cover 340 has been placed in the opening 322 of the footrest 314 with the perforations 342 of the cover 340 in alignment with respective ones of the mounting elements 344,344*a*,344*b*, non-illustrated screws can be passed through the perforations 342 and threaded into the mounting elements 344,344*a*,344*b* to fix the cover 340 to the peripheral wall 326*a*,326*b*,328*a*, 328*b* and to the plate 334. Similarly to the perforations 342, the mounting elements 344,344*a*,344*b* constitute a means for releasably securing the cover 340 to the plate 334 and the peripheral wall 326*a*,326*b*,328*a*,328*b*, i.e., the mounting elements 344,344*a*,344*b* constitute a means for securing the cover 340 to the plate 334 and the peripheral wall 326*a*,

326*b*,328*a*,328*b* and for permitting release of the cover 340 from the plate 334 and the peripheral wall 326*a*,326*b*,328*a*, 328*b* without damage to the cover 340, the plate 334 or the peripheral wall 326*a*,326*b*,328*a*,328*b*.

The mounting elements 344,344*a*,344*b* are here fast with the peripheral wall 326*a*,326*b*,328*a*,328*b* of the footrest 314. It is also possible for the mounting elements 344,344*a*,344*b* to be fast with the plate 334.

One of the mounting elements 344*a* is fixed to the side bar 326*a* of the peripheral wall 326*a*,326*b*,328*a*,328*b* while the other of the mounting elements 344*a* is fixed to the side bar 326*b* of the peripheral wall 326*a*,326*b*,328*a*,328*b*. Likewise, one of the mounting elements 344*b* is fixed to the side bar 326*a* of the peripheral wall 326*a*,326*b*,328*a*,328*b* while the other of the mounting elements 344*b* is fixed to the side bar 326*b* of the peripheral wall 326*a*,326*b*,328*a*,328*b*. The two mounting elements 344*a* are located directly opposite one another as is the case for the two mounting elements 344*b*. A bar-like or rod-like member 346*a* bridges the mounting elements 344*a* whereas a bar-like or rod-like member 346*b* bridges the mounting elements 344*b*. The bar-like or rod-like members 346*a*,346*b* extend across the entire width, or at least the major part of the width, of the opening 322 in the footrest 314 and serve as bracing or supporting elements for the plate 334. The bar-like or rod-like members 346*a*,346*b* are secured to the mounting elements 344*a*,344*b* and/or to the peripheral wall 326*a*,326*b*,328*a*,328*b*, e.g., via fusional bonds.

The footrest 314 and the hanger 216 constitute two separate components which are connected to each other such that the footrest 314 and the hanger 316 can move relative to one another. More particularly, the footrest 314 and the hanger 316 are rotatable or pivotal with respect to each other on an axis which runs in the direction of elongation, and is parallel to the longitudinal axis, of the footrest 314. To this end, the footrest 314 and the hanger 316 can have two non-illustrated joints which are designed in the same manner as those between the footrest 214 and the hanger 216 of the stirrup 210 illustrated in FIGS. 11 and 12. As shown in FIGS. 15 and 16, one of the joints between the footrest 314 and the hanger 316 is surrounded by a sleeve or housing 348*a* while the other of the joints between the footrest 314 and the hanger 316 is surrounded by a sleeve or housing 348*b*. The sleeves 348*a*,348*b* are flexible or elastic thereby allowing the sleeves 348*a*,348*b* to bend as the footrest 314 and the hanger 316 pivot relative to one another. The sleeves 348*a*, 348*b* can, for instance, be made of rubber.

Figure 20:
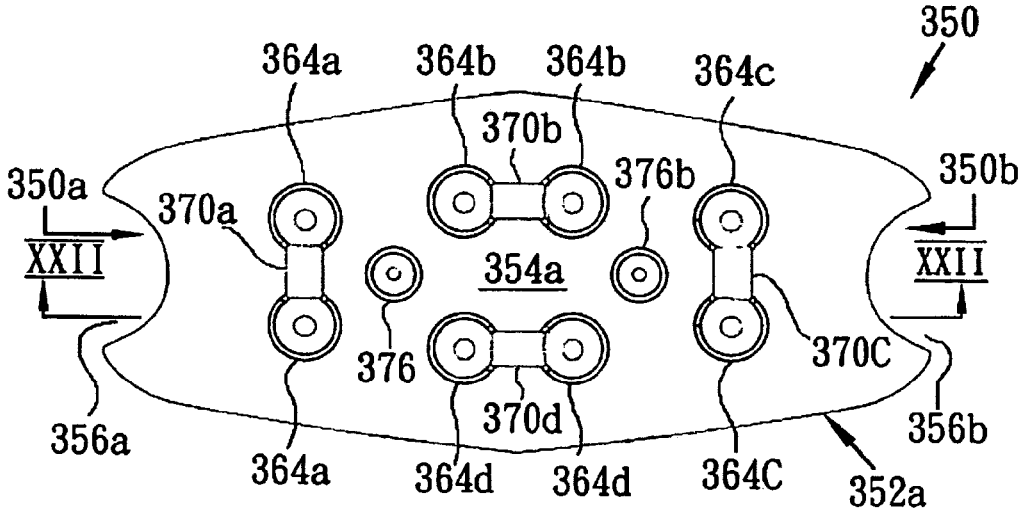
FIG. 20 is a top view of the shock-absorbing body part of the stirrup of FIG. 15.
Figure 21:
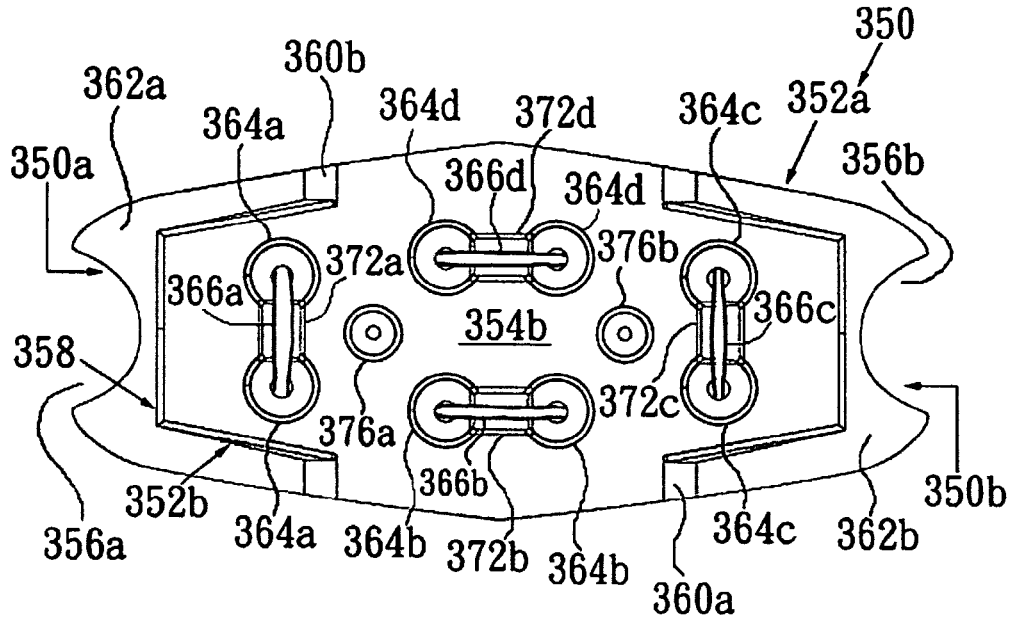
FIG. 21 is a bottom view of the shock-absorbing body constituting part of the stirrup of FIG. 15.
Figure 22:
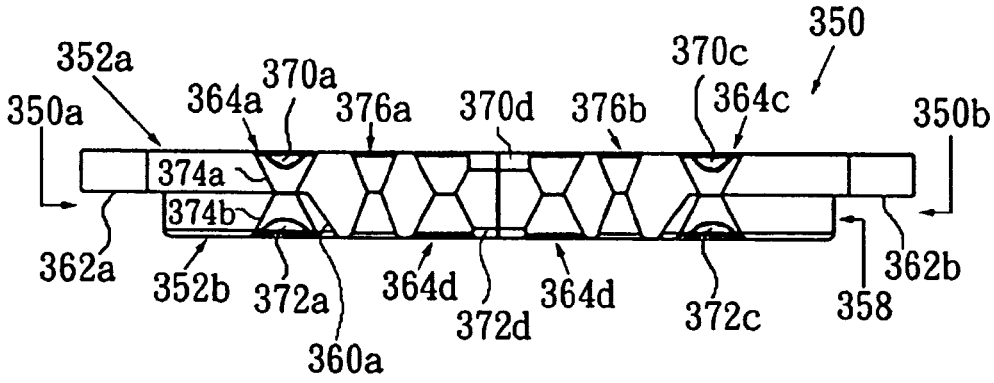
FIG. 22 is a sectional view of the shock-absorbing body forming part of the stirrup of FIG. 15 as seen in the direction of the arrows XXII-XXII of FIG. 20.

Turning to FIGS. 20, 21 and 22, the stirrup 310 additionally comprises a shock absorber which is discrete from and can be releasably attached to the footrest 314. The shock absorber includes an elongated body 350 which serves as a shock-absorbing or cushioning element for the foot of a rider and also functions to releasably attach the shock absorber to the footrest 314. The shock-absorbing body 350 defines one or more substantially leakproof chambers containing gas, and the shock-absorbing body 350 is designed in such a manner that at least the major part of the shock absorber is inflated with gas. The gas used to inflate the shock-absorbing body 350 is preferably air.

The shock-absorbing body 350 is elongated and has opposite longitudinal ends 350*a* and 350*b*. The shock-absorbing body 350 comprises a section 352*a* having approximately the same shape or outline, and approximately the same area or dimensions, as the peripheral wall 326*a*, 326*b*,328*a*,328*b* of the footrest 314. The shock-absorbing body 350 further comprises a section 352*b* which is designed to be situated below the section 352*a* during use. The section 352*a*, which may be referred to as an upper section of the shock-absorbing body 350, has a major surface 354*a* which faces up, and hence faces the hanger 316 of the stirrup 310, while the shock-absorbing body 350 is in use. On the other hand, the section 352*b*, which may be referred to as a lower section of the shock-absorbing body 350, has a major surface 354*b* which faces down when the shock-absorbing body 350 is being used. The major surface 354*a* of the shock-absorbing body 350 can be considered to be an upper major surface of the shock-absorbing body 350 whereas the major surface 354*b* can be considered to be a lower major surface of the shock-absorbing body 350.

The upper section 352*a* of the shock-absorbing body 350 is provided with a recess or indentation 356*a* at the longitudinal end 350*a* of the shock-absorbing body 350 and with a recess or indentation 356*b* at the longitudinal end 350*b* of the shock-absorbing body 350. The recess 356*a* is designed to receive the sleeve 348*a* of the stirrup 310 whereas the recess 356*b* is designed to receive the sleeve 348*b* of the stirrup 310.

The lower section 352*b* of the shock-absorbing body 350 comprises a central portion 358 which is centered laterally and longitudinally with respect to the upper section 352*a* of the shock-absorbing body 350. The central portion 358 of the lower section 352*b* runs longitudinally of the upper section 352*a* from a location near the recess 356*a* to a location near the recess 356*b*. The length of the central portion 358 of the lower section 352*b* is smaller than the distance between the recesses 356*a*,356*b* while the width of the central portion 358 is smaller than the width of the upper section 352*a* of the shock-absorbing body 350. An elongated rib 360*a* is located to one side of the central portion 358 of the lower section 352*b* and extends along part of the length of the central portion 358. A second elongated rib 360*b* is located to the other side of the central portion 358 of the lower section 352*b* and likewise extends along part of the length of the central portion 358. The ribs 360*a*,360*b* are situated directly opposite one another and are centered longitudinally of the central portion 358.

By virtue of the preceding design of the shock-absorbing body 350, a rim 362*a* is formed at the longitudinal end 350*a* of the shock-absorbing body 350 whereas a second rim 362*b* is formed at the longitudinal end 350*b*. The rims 362*a*,362*b*, which constitute part of the upper section 352*a* of the shock-absorbing body 350, are adapted to rest on the peripheral wall 326*a*,326*b*,328*a*,328*b* at the upper side 332*a* of the footrest 314. Referring to FIG. 16 in conjunction with FIGS. 20-22, the rim 362*a*, which runs from the rib 360*a* to the rib 360*b* by way of the recess 356*a*, is adapted to rest on the part of the peripheral wall 326*a*,326*b*,328*a*,328*b* extending from the cutout 330*a* to the cutout 330*b* via the crosspiece 328*a*. On the other hand, the rim 362*b*, which extends from the rib 360*a* to the rib 360*b* by way of the recess 356*b*, is adapted to rest on the part of the peripheral wall 326*a*,326*b*,328*a*, 328*b* running from the cutout 330*a* to the cutout 330*b* via the crosspiece 328*b*.

The rib 360*a* is designed to be received in the cutout 330*a* of the peripheral wall 326*a*,326*b*,328*a*,328*b* and is complementary, or essentially complementary, to the cutout 330*a*. Thus, the rib 360*a* has approximately the same shape or outline, and approximately the same dimensions, as the cutout 330*a*. Similarly, the rib 360*b* is designed to be received in the cutout 330*b* of the peripheral wall 326*a*, 326*b*,328*a*,328*b* and is complementary, or essentially complementary, to the cutout 330*b*. As is the case for the rib 360*a* and the cutout 330*a*, the rib 360*b* has approximately the same shape or outline, and approximately the same dimensions, as the cutout 330*b*.

The central portion 358 of the lower section 352*b* is designed to rest on the plate 334 of the footrest 314, and the plate 334 functions as a support member or rest for the shock-absorbing body 350. The central portion 358 of the lower section 352*b* has approximately the same shape or outline, and approximately the same area or dimensions, as the opening 322 in the footrest 314. The height of the central portion 358 of the lower section 352*b* is approximately equal to the distance between the upper major side 336*a* of the plate 334 and the upper side 372*a* of the footrest 314.

When the shock-absorbing body 350 is properly positioned on the footrest 314, the recess 356*a* in the shock-absorbing body 350 receives the sleeve 348*a* of the stirrup 310 and the recess 356*b* in the shock-absorbing body 350 receives the sleeve 348*b* of the stirrup 310. The rim 362*a* of the shock-absorbing body 350 rests on the crosspiece 328*a* of the peripheral wall 326*a*,326*b*,328*a*,328*b* and on the segments of the peripheral wall 326*a*,326*b*,328*a*,328*b* between the crosspiece 328*a* and the cutouts 330*a*,330*b*. Likewise, the rim 362*b* of the shock-absorbing body 350 rests on the crosspiece 328*b* of the peripheral wall 326*a*, 326*b*,328*a*,328 and on the segments of the peripheral wall 326*a*,326*b*,328*a*,328 between the crosspiece 328*b* and the cutouts 330*a*,330*b*. The central portion 358 of the shock-absorbing body 350 bears against the plate 334 in the opening 322 of the footrest 314 whereas the rib 360*a* of the shock-absorbing body 350 is received in the cutout 330*a* and the rib 360*b* of the shock-absorbing body 350 is received in the cutout 330*b*.

The shock-absorbing body 350 is provided with means for releasably attaching the shock-absorbing body 350 to the plate 334, i.e., the shock-absorbing 350 is provided with means for attaching the shock-absorbing body 350 to the plate 334 and for permitting release of the shock-absorbing body 350 from the plate 334 without damage to the shock-absorbing body 350 or the plate 334. The means for releasably attaching the shock-absorbing body 350 to the plate 334 is here in the form of a pair of passages or channels 364*a*, a pair of passages or channels 364*b*, a pair of passages or channels 364*c* and a pair of passages or channels 364*d* which open to the upper major surface 354*a* and the lower major surface 354*b* of the shock-absorbing body 350. The passages 364*a*,364*b*,364*c*,364*d* extend through the shock-absorbing body 350 from the upper major surface 354*a* of the shock-absorbing body 350 to the lower major surface 354*b* thereof.

By way of example, the passages 364*a*,364*b*,364*c*,364*d* can be used to tie the shock-absorbing body 350 to the plate 334 of the footrest 314. This is illustrated in FIGS. 17 and 21 where four ties or tying members 366*a*, 366*b*, 366*c* and 366*d* are shown. The tie 366*a* extends through the passages 364*a*; the tie 366*b* extends through the passages 364*b*; the tie 366*c* extends through the passages 364*c*; and the tie 366*d* extends through the passages 364*d*. The ties 366*a*,366*b*, 366*c*,366*d* can be conventional and may take any form capable of firmly holding the shock-absorbing body 350 on the plate 334 of the footrest 314. For instance, the ties 366*a*,366*b*,366*c*,366*d* can be nylon ties of the type having one end provided with teeth and another end provided with a catch which can receive and hold the toothed end.

Considering FIG. 18, the plate 334 of the footrest 314 is provided with means for releasably connecting an object such as the shock-absorbing body 350 to the plate 334, i.e., the plate 334 is provided with means for connecting an object to the plate 334 and for permitting release of the object from the plate 334 without damage to the object or the plate 334. The plate 334 is here designed for connection of the shock-absorbing body 350 to the plate 334 and the means for releasably connecting the shock-absorbing body 350 to the plate 334 comprises a pair of apertures 368*a*, a pair of apertures 368*b*, a pair of apertures 368*c* and a pair of apertures 368*d*. The apertures 368*a*,368*b*,368*c*,368*d* are arranged in such a manner that, when the shock-absorbing body 350 is properly positioned on the footrest 314, the passages 364*a* in the shock-absorbing body 350 are in register with respective ones of the apertures 368*a* in the plate 334; the passages 364*b* in the shock-absorbing body 350 are in register with respective ones of the apertures 368*b* in the plate the passages 364*a* in the shock-absorbing body 350 are in register with respective ones of the apertures 368*a* in the plat 334; the passages 364*c* in the shock-absorbing body 350 are in register with respective ones of the apertures 368*c* in the plate 334; and the passages 364*d* in the shock-absorbing body 350 are in register with respective ones of the apertures 368*d* in the plate 334.

To secure the shock-absorbing body 350 to the plate 334, one end of the tie 366*a* is passed through a first passage 364*a* and the registering aperture 368*a* while the other end of the tie 366*a* is passed through the second passage 364*a* and the registering aperture 368*a*; one end of the tie 366*b* is passed through a first passage 364*b* and the registering aperture 368*b* while the other end of the tie 366*b* is passed through the second passage 364*b* and the registering aperture 368*b*; one end of the tie 366*c* is passed through a first passage 364*c* and the registering aperture 368*c* while the other end of the tie 366*c* is passed through the second passage 364*c* and the registering aperture 368*c*; and one end of the tie 366*d* is passed through a first passage 364*d* and the registering aperture 368*d* while the other end of the tie 366*d* is passed through the second passage 364*d* and the registering aperture 368*d*. As seen in FIG. 17, the ties 366*a*,366*b*,366*c*,366*d* are inserted in the passages 364*a*,364*b*,364*c*,364*d* and the registering apertures 368*a*,368*b*,368*c*,368*d* in such a manner that the ends of the ties 366*a*,366*b*,366*c*,366*d* enter the space 338 defined by the plate 334 and the peripheral wall 326*a*, 326*b*,326*c*,326*d*. Once the ties 366*a*,366*b*,366*c*,366*d* have been inserted in the passages 364*a*,364*b*,364*c*,364*d* and the registering apertures 368*a*,368*b*,368*c*,368*d*, the ends of each tie 366*a*,366*b*,366*c*,366*d* are secured to one another. The ties 366*a*,366*b*,366*c*,366*d* are tightened thereby anchoring the shock-absorbing body 350 to the plate 334.

After the ends of each tie 366*a*,366*b*,366*c*,366*d* have been secured to one another and the ties 366*a*,366*b*,366*c*,366*d* have been tightened, the cover 340 is placed over the cavity 338 and attached to the footrest 314. The ends of the ties 366*a*,366*b*,366*c*,366*d* are then confined in the space 338 and no longer exposed.

Referring to the sectional view of FIG. 22, it is noted that the illustrated embodiment of the shock-absorbing body 350 is transparent. The transparency of the shock-absorbing body 350 is due, at least in part, to the method of manufacture of the shock-absorbing body 350. The shock-absorbing body 350 is formed by pressing together two appropriately designed pieces of material, fusing the two pieces of material to one another and inflating the resulting product. It has been found that enhanced transparency can be achieved by fusing the two pieces of material along a line which is located at the periphery of the shock-absorbing body 350 and, along the rims 362*a*,362*b*, is disposed at approximately the level of the junction between the upper section 352*a* of the shock-absorbing body 350 and the central portion 358 of the lower section 352*b*. Intermediate the rims 362*a*,362*b*, the fusion line extends along the outer peripheries of the ribs

360*a*,360*b* of the shock-absorbing body 350. The shock-absorbing body 350 can, for example, be made of rubber.

Turning to FIGS. 20 and 21 in conjunction with FIG. 22, the upper major surface 354*a* of the shock-absorbing body 350 is provided with an indentation or depression 370*a* which bridges the two passages 364*a*; an indentation or depression 370*b* which bridges the two passages 364*b*; an indentation or depression 370*c* which bridges the two passages 364*c*; and an indentation or depression 370*d* which bridges the two passages 364*d*. Similarly, the lower major surface 354*b* of the shock-absorbing body 350 is formed with an indentation or depression 372*a* which bridges the two passages 364*a*; an indentation or depression 372*b* which bridges the two passages 364*b*; an indentation or depression 372*c* which bridges the two passages 364*c*; and an indentation or depression 372*d* which bridges the two passages 364*d*. The indentations 370*a*,372*a* are adapted to receive the parts of the tie 366*a* which span the passages 364*a*; the indentations 370*b*,372*b* are adapted to receive the parts of the tie 366*b* which span the passages 364*b*; the indentations 370*c*,372*c* are adapted to receive the parts of the tie 366*c* which span the passages 364*c*; and the indentations 370*d*, 372*d* are adapted to receive the parts of the tie 366*d* which span the passages 364*d*. Thus, the parts of the tie 366*a* between the passages 364*a*; the parts of the tie 366*b* between the passages 364*b*; the parts of the tie 366*c* between the passages 364*c*; and the parts of the tie 366*d* between the passages 364*d* are recessed relative to the major surfaces 354*a*,354*b* of the shock-absorbing body 350 and do not project beyond the major surfaces 354*a*,354*b*.

The passages 364*a*,364*b*,364*c*,364*d* in the shock-absorbing body 350 not only function to permit attachment of the shock-absorbing body 350 to the plate 334 of the footrest 314 but are also designed to stabilize or reinforce the shock-absorbing body 350. To this end, each of the passages 364*a*,364*b*,364*c*,364*d* comprises two tapering portions 374*a* and 374*b* as shown in FIG. 22. The tapering portions 374*a* of the passages 364*a*,364*b*,364*c*,364*d* extend from the upper major surface 354*a* of the shock-absorbing body 350 partway to the lower major surface 354*b* while the tapering portions 374*b* extend from the lower major surface 354*b* partway to the upper major surface 354*a*. The tapering portion 374*a* of each passage 364*a*,364*b*,364*c*,364*d* narrows progressively in a direction from the upper major surface 354*a* of the shock-absorbing body 350 towards the lower major surface 354*b* while the tapering portion 374*b* of each passage 364*a*,364*b*,364*c*,364*d* narrows progressively in a direction from the lower major surface 354*b* towards the upper major surface 354*a*. Hence, each of the tapering portions 374*a* has a wider end at the upper major surface 354*a* and a narrower end remote from the upper major surface 354*a*. Likewise, each of the tapering portions 374*b* has a wider end at the lower major surface 354*b* and a narrower end remote from the lower major surface 354*b*. The narrower ends of the two tapering portions 374*a*,374*b* of each passage 364*a*,364*b*,364*c*,364*d* are in register with and abut one another. The abutting ends are advantageously located midway between the upper major surface 354*a* and the lower major surface 354*b* of the shock-absorbing body 350.

The tapering portions 374*a*,374*b* of the passages 364*a*, 364*b*,364*c*,364*d* are preferably frustoconical as illustrated.

Considering FIGS. 20 and 21 together with FIG. 22, the shock-absorbing body 350 is provided with two channels or passages 376*a* and 376*b* which extend from the upper major surface 354*a* of the shock-absorbing body 350 to the lower major surface 354*b* and have the same design as the passages 364*a*,364*b*,364*c*,364*d*. The channel 376*a* is located between the pair of passages 364*a* and the two pairs of passages 364*b*,364*d* while the channel 376*b* is located between the pair of passages 364*c* and the two pairs of passages 364*b*, 364*d*. The channels 376*a*,376*b*, which are centered laterally of the shock-absorbing body 350, serve primarily to further stabilize or reinforce the shock-absorbing body 350.

The passages 364*a*,364*b*,364*c*,364*d* and the channels 376*a*,376*b* inhibit overinflation and deformation of the shock-absorbing body 350.

Figure 23:
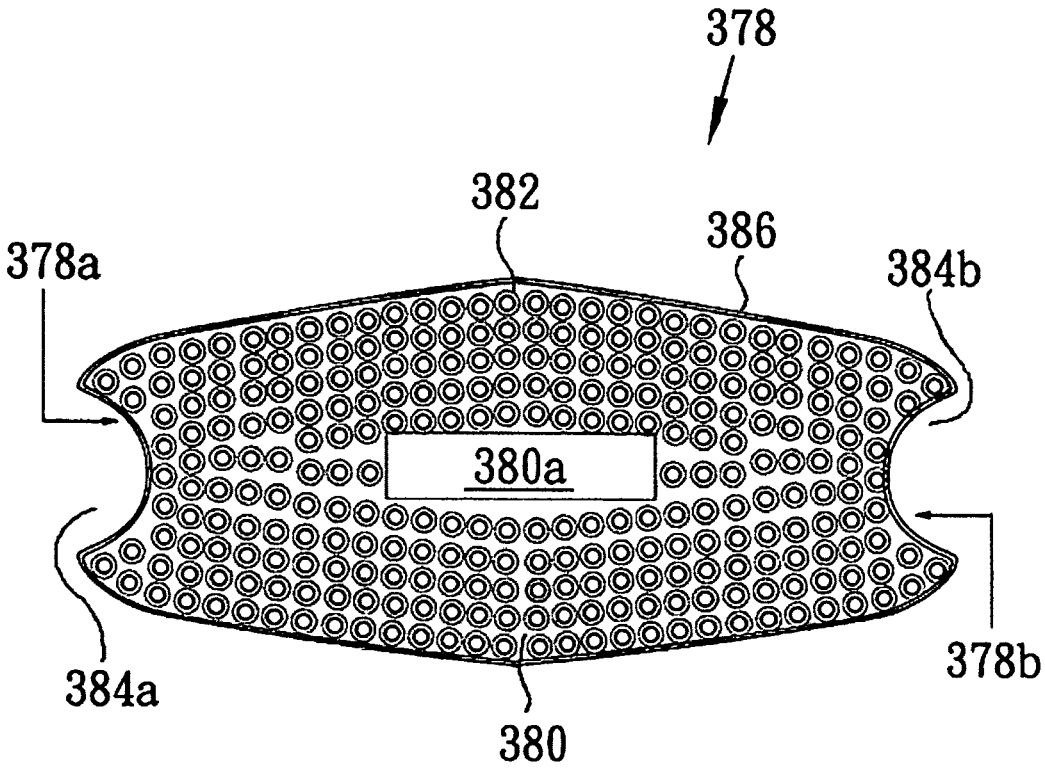
FIG. 23 is a top view of the tread constituting part of the stirrup of FIG. 15.

Referring to FIGS. 15 and 23, the stirrup 310 additionally comprises a nonslip member or tread 378 having a sheet-like support or base 380 which is advantageously flexible or resilient. The base 380 has approximately the same shape or outline, and approximately the same area or dimensions, as the upper section 352*a* of the shock-absorbing body 350. The base 380 has a major surface 380*a* which is normally directed upward when the stirrup 310 is in use and the tread 378 is properly situated on the footrest 314, and the surface 380*a* is provided with a multiplicity of protrusions 382 which are designed to bear against the sole of a riding boot. The base 380 further has a non-illustrated major surface which normally faces downward during use, and such surface is designed to be secured to the upper major surface 354*a* of the shock-absorbing body 350 to form a nonslip article for the stirrup 310. The base 380 may be secured to the shock-absorbing body 350 in any suitable manner, e.g., adhesively.

The protrusions 382 can have the same configuration, and can be made of the same material, as the protrusions 280 of the tread 276 forming part of the stirrup 210.

The tread 378 is elongated and has opposed longitudinal ends 378*a* and 378*b*. The longitudinal end 378*a* is provided with a recess or indentation 384*a* which is designed to receive the sleeve 348*a* of the stirrup 310 while the longitudinal end 378*b* is designed to receive the sleeve 348*b* of the stirrup 310.

The tread 378 advantageously includes a rim or wall 386 which projects from and is generally perpendicular to the major surface 380*a* supporting the protrusions 382. The rim 386 runs along the periphery of the major surface 380*a* and circumscribes the protrusions 382. The height of the rim 386 preferably does not exceed the height of the protrusions 382.

Various modifications are possible within the meaning and range of equivalence of the appended claims.

I claim:

1. A stirrup comprising:

a support for a foot; and a suspending element for suspending said support on an animal, said support including a peripheral wall which circumscribes an opening having a shape and an area, and said support further including a plate-like member in said opening which is permanently fixed to said peripheral wall and has approximately said shape and approximately said area;

wherein said plate-like member is fixed to said peripheral wall by at least one bond connecting the plate-like member to the peripheral wall.

2. The stirrup of claim 1, wherein said plate-like member is provided with means for releasably connecting an object to said plate-like member.

3. The stirrup of claim 2, wherein said connecting means comprises apertures in said plate-like member.

4. The stirrup of claim 1, further comprising a shock-absorbing body having means for releasably attaching said shock-absorbing body to said plate-like member.

5. The stirrup of claim 1, further comprising a nonslip member for inhibiting slippage of a foot resting on said support.

6. A stirrup comprising:

a support for a foot; and a suspending element for suspending said support on an animal, said support including a peripheral wall which circumscribes an opening having a shape and an area, and said support further including a plate-like member in said opening which is permanently fixed to said peripheral wall and has approximately said shape and approximately said area;

wherein said support additionally includes at least one bracing member for said plate-like member, said opening having a width, and said at least one bracing member being mounted on said peripheral wall and spanning at least a major part of said width.

7. A stirrup comprising:

a support for a foot;

a suspending element for suspending said support on an animal, said support including a peripheral wall which circumscribes an opening having a shape and an area, and said support further including a plate-like member in said opening which is fixed to said peripheral wall and has approximately said shape and approximately said area, said plate-like member having opposed major sides and said suspending element being located to one of said sides, said peripheral wall and said plate-like member defining a space to the other of said sides; and a cover for said space.

8. The stirrup of claim 7, wherein at least one of said peripheral wall and said plate-like member is provided with means for releasably securing said cover to said peripheral wall.

9. A comprising;

a support for a foot;

a suspending element for suspending said support on an animal, said support including a peripheral wall which circumscribes an opening having a shape and an area, and said support further including a plate-like member in said opening which is fixed to said peripheral wall and has approximately said shape and approximately said area; and a shock-absorbing body having means for releasably attaching said shock-absorbing body to said plate-like member, at least the major part of said shock-absorbing body being inflated with gas.

10. A comprising:

a support for a foot;

a suspending element for suspending said support on an animal, said support including a peripheral wall which circumscribes an opening having a shape and an area, and said support further including a plate-like member in said opening which is fixed to said peripheral wall and has approximately said shape and approximately said area; and a shock-absorbing body having means for releasably attaching said shock-absorbing body to said plate-like member, said shock-absorbing body having opposed surfaces and said attaching means comprising passages which extend from one of said surfaces to the other of said surfaces.

11. The stirrup of claim 10, further comprising at least one tying member designed to extend through said passages and tie said shock-absorbing body to said plate-like member.

12. The stirrup of claim 11, wherein said one surface is provided with at least one indentation, said at least one indentation being designed to receive a part of said tying member so that said part of said tying member is recessed relative to said one surface.

13. The stirrup of claim 10, wherein at least one of said passages is designed to stabilize said shock-absorbing body and includes at least one tapering portion.

14. The stirrup of claim 13, wherein said at least one tapering portion is substantially frustoconical.

15. The stirrup of claim 13, wherein said at least one passage comprises a pair of tapering portions, one of said tapering portions extending from said one surface partway to said other surface and the other of said tapering portions extending from said other surface partway to said one surface.

16. The stirrup of claim 15, wherein each of said tapering portions has a wider end and a narrower end, said narrower ends being in register with each other and abutting one another.

17. A stirrup comprising:

a support for a foot; and a suspending element for suspending said support on an animal, said support including a peripheral wall which circumscribes an opening having a shape and an area, and said support further including a plate-like member in said opening which is permanently fixed to said peripheral wall and has approximately said shape and approximately said area;

wherein said peripheral wall is provided with at least one cutout; and further comprising a shock-absorbing body having at least one rib which is substantially complementary to said at least one cutout.

18. A stirrup comprising:

a support for a foot;

a suspending element for suspending said support on an animal; and a shock-absorbing body positioned on said support in such a manner that a foot bearing on said support rests on said shock-absorbing body, said shock-absorbing body having first exterior surface which faces said suspending element and a second exterior surface which faces away from said suspending element, and said shock-absorbing body being provided with a passage for at least one of the functions of attaching said shock-absorbing body to said support and stabilizing said shock-absorbing body, said passage extending from one of said surfaces to the other of said surfaces and being circumferentially complete along at least part of the distance between said surfaces;

wherein at least the major part of said body is inflated with gas.

19. The stirrup of claim 18, wherein said gas comprises air.

20. The stirrup of claim 18, wherein said shock-absorbing body has a plurality of said passage extending from one of said surfaces to the other of said surfaces.

21. The stirrup of claim 18, wherein said passage is designed to stabilize said shock-absorbing body and includes at least one tapering portion.

22. The stirrup of claim 21, wherein said at least one tapering portion is substantially frustoconical.

23. A shock absorber for the footrest of a stirrup comprising:

a shock-absorbing body having means for releasably attaching said shock-absorbing body to the footrest, said attaching means being designed to permit tying of said shock-absorbing body to the footrest, and said shock-absorbing body having opposed surfaces, said attaching means including passages which extend from one of said surfaces to the other of said surfaces, and said one surface being provided with at least one indentation, said at least one indentation being designed to receive a part of a tying member adapted to extend through said passages and tie said shock-absorbing body to the footrest so that such part of the tying member is recessed relative to said one surface.

24. A shock absorber for the footrest of a stirrup comprising:

a shock-absorbing body having means for releasably attaching said shock-absorbing body to the footrest, said attaching means being designed to permit tying of said shock-absorbing body to the footrest, and said shock-absorbing body having opposed surfaces, said attaching means including passages which extend from one of said surfaces to the other of said surfaces, and at least one of said passages being designed to stabilize said shock-absorbing body, said at least one passage comprising a pair of tapering portions, one of said tapering portions extending from said one surface partway to said other surface and the other of said tapering portions extending from said other surface partway to said one surface.

25. The shock absorber of claim 24, wherein each of said tapering portions has a wider end and a narrower end, said narrower ends being in register with each other and abutting one another.

26. A shock absorber for the footrest of a stirrup comprising:

a shock-absorbing body inflated with gas throughout at least the major part thereof, said shock-absorbing body being provided with means for stabilizing said shock-absorbing body, and said stabilizing means including at least one passage which comprises a pair of tapering portions, said shock-absorbing body having opposed surfaces, and one of said tapering portions extending from one of said surfaces partway to the other of said surfaces, the other of said tapering portions extending from said other surface partway to said one surface.

27. The shock absorber of claim 26, wherein each of said tapering portions has a wider end and a narrower end, said narrower ends being in register with each other and abutting one another.

* * * * *